US005646717A

United States Patent [19]

Hiroshima et al.

[11] Patent Number: 5,646,717

[45] Date of Patent: Jul. 8, 1997

[54] IMAGE FORMING APPARATUS HAVING CHARGING MEMBER

[75] Inventors: Koichi Hiroshima, Kawasaki; Masahiro Goto, Yokohama; Yoji Serizawa, Kawasaki; Makoto Takeuchi, Tokyo; Tatsunori Ishiyama, Yokohama, all of Japan

[73] Assignee: Canon Kabushiki Kaisha, Tokyo, Japan

[21] Appl. No.: 388,889

[22] Filed: Feb. 14, 1995

Related U.S. Application Data

[63] Continuation of Ser. No. 140,627, Oct. 25, 1993, abandoned, which is a continuation of Ser. No. 905,117, Jun. 26, 1992, abandoned.

[30] Foreign Application Priority Data

| | | | |
|---|---|---|---|
| Jun. 28, 1991 | [JP] | Japan | 3-158480 |
| Jun. 28, 1991 | [JP] | Japan | 3-185328 |
| Jun. 28, 1991 | [JP] | Japan | 3-185330 |

[51] Int. Cl.[6] ..... G03G 15/16

[52] U.S. Cl. ..... 399/154; 399/9; 399/10; 399/168; 399/158; 399/296

[58] Field of Search ..... 355/203, 204, 355/208, 219, 271, 273, 274, 276, 277; 361/225

[56] References Cited

U.S. PATENT DOCUMENTS

| | | | |
|---|---|---|---|
| 3,781,105 | 12/1973 | Meagher | 355/274 |
| 3,816,756 | 6/1974 | Bresnick | 355/246 X |
| 4,912,515 | 3/1990 | Amemiya et al. | 355/274 |
| 4,959,688 | 9/1990 | Koitatashi | 355/219 |
| 4,977,430 | 12/1990 | Florack et al. | 355/274 |
| 5,006,902 | 4/1991 | Araya | 355/271 |
| 5,034,777 | 7/1991 | Ohzeki et al. | 355/274 |
| 5,124,732 | 6/1992 | Manzer et al. | 346/154 |
| 5,128,717 | 7/1992 | Uchikawa et al. | 355/208 |
| 5,151,736 | 9/1992 | Ohzeki et al. | 355/208 |
| 5,313,359 | 5/1994 | Imagawa et al. | 361/225 |

FOREIGN PATENT DOCUMENTS

| | | |
|---|---|---|
| 0367245 | 5/1990 | European Pat. Off. . |
| 0368617 | 5/1990 | European Pat. Off. . |
| 0391306 | 10/1990 | European Pat. Off. . |
| 0404079 | 12/1990 | European Pat. Off. . |
| 0428172 | 5/1991 | European Pat. Off. . |
| 0442527 | 8/1991 | European Pat. Off. . |
| 2-287280 | 11/1990 | Japan . |
| 3-89283 | 4/1991 | Japan . |
| 0156476 | 7/1991 | Japan . |
| 0157681 | 7/1991 | Japan . |
| WO89/80283 | 9/1989 | WIPO . |

*Primary Examiner*—Matthew S. Smith

*Attorney, Agent, or Firm*—Fitzpatrick, Cella, Harper & Scinto

[57] ABSTRACT

An image forming apparatus includes image forming device for forming an image on a recording material, the image forming device including an image bearing member, a charging member for charging the image bearing member and a voltage source for supplying a voltage to the charging member; and determining device for determining a substantial intersection between an actual voltage-current characteristic curve between the charging member and the image bearing member and a predetermined voltage-current curve predetermined for the charging member, and for determining a bias to be applied to the charging member during image forming operation of the basis of the intersection.

115 Claims, 29 Drawing Sheets

IMAGE FORMING APPARATUS HAVING CHARGING MEMBER

This application is a continuation of application Ser. No. 08/140,627 filed Oct. 25, 1993, now abandoned, which was a continuation of application Ser. No. 07/905,117 filed Jun. 26, 1992, now abandoned.

FIELD OF THE INVENTION AND RELATED ART

The present invention relates to an image forming apparatus having a charging member, more particularly to an image forming apparatus in which a transferable image such as a toner image is formed through image forming process such as an electrophotographic, electrostatic or magnetic recording process on a photoconductive photosensitive member, dielectric member or magnetic member or the like, further particularly to such an image forming apparatus in which a recording material is passed through an image transfer station between the image bearing member and a transfer charging member in the form of a roller or belt to transfer the image from the image bearing member to the recording material.

An image forming apparatus is known in which an image bearing member is charged by a contact type charging member for the purpose of recording an image on a recording material such as paper. Further, it is known that an image transfer bias voltage applied to the transfer member is constant-voltage-controlled or constant-current-controlled.

The transfer roller or the like used as the contact charging member is usually made of rubber material in which conductive particles are dispersed to provide a proper volume resistivity. As is known, the resistance of the material varies depending on the ambient conditions by several orders, with the result of difficulty in applying a stabilized transfer bias irrespective of the ambient condition.

More particularly, the proper transfer bias voltage is set for the normal temperature and normal humidity condition (23° C., 68% RH) which will be called "N/N" condition, the improper image transfer action occurs under a low temperature and low humidity condition (15° C., 10% RH) which will hereinafter be called "L/L" condition, since the resistances of the transfer roller and the recording material are large. Under the high temperature and high humidity condition (32° C., 85% RH) which will hereinafter be called "H/H" condition, the resistance of the transfer roller becomes low with the result of too high bias voltage. In this case, the electric charge may penetrate through the transfer material, and a part of the toner is charged to the same polarity as the transfer bias so that it is not transferred onto the transfer material. Then, the image locally fails to transfer to the transfer material, or the excessive electric current flows into the image bearing member (photosensitive drum), with the result of transfer memory in image bearing member.

When the constant current control is carried out, the above inconveniences attributable to the variations in the resistance of the transfer roller, can be avoided, and the amount of electric charge necessary for the image transfer can be maintained. The image forming apparatus of this kind is usually usable with various sizes of the transfer materials. When the small size transfer material is used, there necessarily exists the portion where the image bearing member and the transfer roller are directly contacted with each other. If the direct contact area is large, most of the electric current flows through such the direct contact area, with the result of improper image transfer because of the short of the transfer electric charge, particularly under the L/L condition.

In order to avoid this inconvenience, an active transfer voltage control (ATVC) system has been proposed in EP-A 367245, in which the constant current control is carried out while the transfer material is absent in the transfer station, and the voltage appearance at this time is held, and a constant voltage control is carried out when the transfer material is present in the transfer station.

More particularly, a constant current is supplied from the transfer roller to a dark potential ($V_D$ portion) of the photosensitive drum, and the produced voltage is monitored. In accordance with the voltage, the applied transfer bias voltage is controlled during the image transfer operation. This is advantageous in that the variation in the image transfer property due to the ambient condition change or the transfer material size variation, can be avoided.

However the transfer roller or the transfer member described above involves the problem that the relation between the current flowing to the photosensitive drum and the current flowing to the transfer material is different depending on the resistance of the transfer member.

Referring to FIG. 10, there is shown voltage-current curve (V-I curve) during absence of the transfer material and during presence of the transfer material when the transfer member is a contact transfer roller. The voltage-current curves are given for a low resistance transfer roller a and a high resistance transfer roller b for the presence of the transfer material, absence of the transfer material (current to the photosensitive drum) and the presence of the sheet (the current to the transfer material and to the transfer drum). The solid line curves represent the non-passage of the sheet, and the broken line curves represent the case of the absence of the transfer material, and the broken line curve represents the case of the presence of the transfer material.

It will be understood from FIG. 10 that the V-I characteristics are significantly different depending on the presence or absence of the transfer material. Therefore, the contact type transfer member such as a transfer roller is easily influenced by a variation of load impedance relative to the photosensitive drum such as the absence or presence of the transfer material, size of the transfer material or the like. The same problems arise when a small gap is provided between the transfer member or roller and the photosensitive drum, the gap being smaller than the thickness of the transfer material.

Therefore, in order to properly select the image transfer bias, the variation in the load impedance is to be taken into account. More particularly, it is desirable to control so as to provide a constant electric current through the transfer material irrespective of the resistance of the transfer member. It would be considered that the transfer bias is controlled by the constant current control, the constant current flows through the transfer material, but when a small size transfer material is used, the current flows more into the surface of the photosensitive member where the load impedance is small, that is, not through the transfer material.

In the ATVC system, the current flows through the transfer member and through the photosensitive drum, the resistance of the transfer member is detected on the basis of the voltage produced, and the electric current during the transfer operation is predicted. On the basis of the prediction, the proper voltage is applied. It, however, involves the problem that the control accuracy is not high because the control current is only at one level. In addition, the resistance of the transfer member actually has a voltage dependency, and therefore, the prediction in the ATVC system is not sufficient. For these reasons, when the resistance of the transfer member changes with long term use, the ambient condition change and/or the voltage dependency, the proper control is not accomplished with the result of the improper image transfer.

SUMMARY OF THE INVENTION

Accordingly, it is a principal object of the present invention to provide an image forming apparatus in which a bias voltage to the charging member is properly controlled.

It is another object of the present invention to provide an image forming apparatus in which a bias voltage to a charging member such as a transfer member is controlled in accordance with manufacturing variation of the charging member in the resistance, ambient condition change, change with long term use and/or voltage variation.

It is a further object of the present invention to provide an image forming apparatus in which a latitude of the resistance of the transfer member is wide.

It is a further object of the present invention to provide an image forming apparatus in which the latitude of the resistance of the transfer member is wide, and the proper transfer voltage can be applied.

It is a further object of the present invention to provide an image forming apparatus in which a high image transfer efficiency is maintained substantially independently from the resistance variation of the transfer member.

It is a further object of the present invention to provide an image forming apparatus in which the latitude of the apparatus is increased, the manufacturing yield is improved, and therefore, the cost of the apparatus is reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiments of the present invention will be described.

Figure 1:
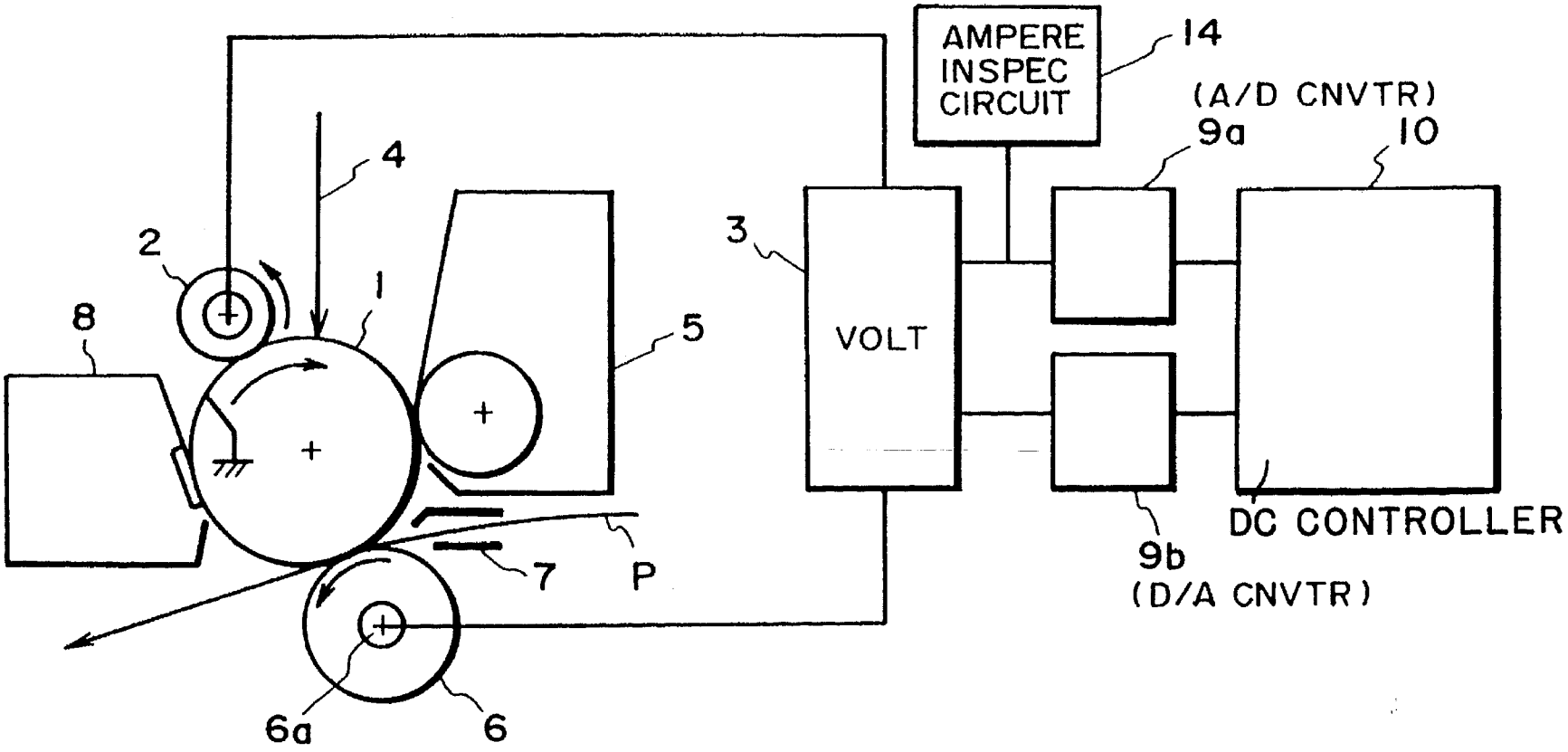
FIG. 1 is a sectional view of an image forming apparatus in the form of a laser beam printer according to an embodiment of the present invention.

Referring to FIG. 1, there is shown an example of an image forming apparatus according to an embodiment of the present invention. In this embodiment, the image forming apparatus is in the form of a laser beam printer using an electrophotographic process.

The image forming apparatus comprises an image bearing member in the form of a rotatable electrophotographic drum 1. The photosensitive drum 1 comprises a grounded conductive drum base made of aluminum or the like and an OPC photosensitive layer (organic photoconductive layer) on the outer surface of the drum base. It is rotated in the direction indicated by an arrow at a process speed (peripheral speed) of 50 mm/sec. The throughput of the printer is 8 (A4 size) sheets/minute at the maximum.

The apparatus further comprises a primary charging roller 2 functioning as a means for electrically charging the photosensitive drum 1. It is press-contacted to the photosensitive drum 1 with a predetermined pressure and is rotated by the rotation of the photosensitive drum 1. The charging roller 2 is supplied from a voltage source 3 with a bias voltage in the form of a DC biased AC voltage, and uniformly charges the outer periphery of the rotating photosensitive drum 1 to the negative polarity. The voltage source 3 is controlled by a DC controller 10 through A/D converter 9*a* and D/A converter 9*b* so that a DC voltage thereof is constant-voltage controlled and that an AC voltage is constant-current controlled.

Thus, the surface of the rotating photosensitive drum 1 is uniformly charged to the negative polarity. Such a surface of the photosensitive drum 1 is scanningly exposed to a laser beam 4 which is produced by an unshown laser scanner with modification in accordance with the desired image information. By this image exposure, the electric potential of the photosensitive member is reduced in the portion exposed to the laser beam, so that an electrostatic latent image is formed in accordance with the image information on the rotating photosensitive drum 1. The electrostatic latent image is developed with negative toner into a toner image.

A recording material or a transfer sheet of paper P in this embodiment is supplied from an unshown sheet feeding station along a conveying passage 7 in a timed relation with rotation of the photosensitive drum 1 to an image transfer position where the photosensitive drum 1 and a charging member in the form of a transfer roller 6 are contacted to the transfer drum 1. In the transfer position, the toner image formed on the photosensitive drum 1 is sequentially transferred onto the transfer material P. The transfer roller 6 is press-contacted to the photosensitive drum 1 with a predetermined pressure at the transfer position. The transfer roller 6 rotates in the same peripheral direction as and at substantially the same speed as the periphery of the photosensitive drum 1. The transfer roller 6 is supplied with a positive polarity transfer bias from the voltage source 3. During the image transfer operation, the transfer roller 6 is contacted to the backside of the transfer material P and is rotated, so that the electric charge having the polarity opposite to that of the toner image are applied to the backside of the transfer material. Between the transfer roller 6 and the photosensitive drum 1, a gap which is smaller than the thickness of the transfer material P may be provided so that the transfer material is pressed to the photosensitive drum 1 by the transfer roller 6 during the transfer operation.

The transfer material P having passed through the transfer position is sequentially separated from the rotating photosensitive drum 1, and is conveyed into an unshown image fixing device where the transferred toner image is fixed on the transfer material P.

After the transfer of the toner image onto the transfer material P, the surface of the photosensitive drum 1 is cleaned by a cleaner 8 so that the residual toner or another residual matters are removed, and the photosensitive drum 1 is prepared for the repeated image forming operation.

In the manner described above, a toner image is formed on a recording material (transfer material P) by the use of the photosensitive drum 1, the charging roller 2, the laser scanner, the developing device 5, the transfer roller 6 and the like.

The materials usable for the transfer roller 6 in this embodiment include urethane rubber, silicone rubber, EPR (ethylene propylene rubber), EPDM (percopolymer of ethylene propylenediene), IR (isoprene rubber) or the like. In this embodiment, EPDM material was used. An electrically conductive material is dispersed in the EPDM rubber. The conductive material may be carbon, zinc oxide, tin oxide or the like. In this embodiment, the zinc oxide showing a relatively high volume resistivity was used. The EPDM material in which the zinc oxide is dispersed is foamed and is applied onto a core metal 6*a* of stainless steel having a diameter of 8 mm, into a thickness of 6 mm, so that a foamed EPDM transfer roller 6 having an outer diameter of 20 mm was prepared.

The resistance of the transfer roller is measured in the following manner. It is electrically grounded with a pressure of approx. 300 gf, and is rotated at a peripheral speed of approx. 50 mm/sec. A voltage of 1.0 KV is applied across the transfer roller and the resultant electric current is measured under the condition of 23° C. and 64% relative humidity. The electric resistance is determined from the applied voltage and the measured current. It has been found that the resistance varies between approx. $5–10^7$ and $5–10^9$ Ω, depending on the lots. The primary charge voltage, that is, the dark portion potential $V_D$ of the photosensitive drum 1 is −600 V, and the exposed portion potential, that is, the light portion potential $V_L$ is −100 V.

Figure 2:
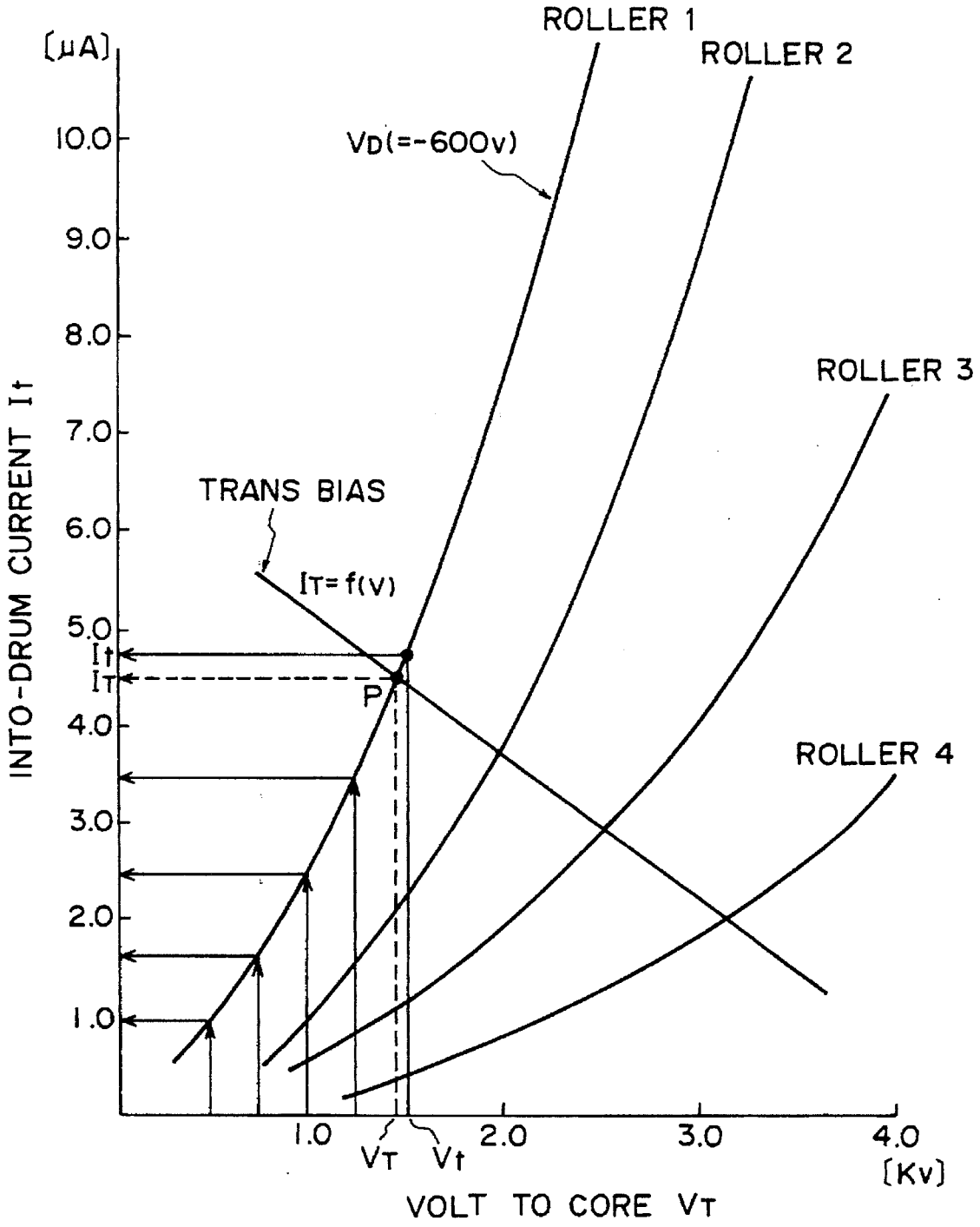
FIG. 2 is a V-I curve for illustrating the principle of the resistance detecting mode in the apparatus of the embodiment.

FIG. 2 shows V-I curves of the following transfer rollers Nos. 1–4:

Roller No. 1=$3.0\times10^8$ Ω

Roller No. 2=$5.5\times10^8$ Ω

Roller No. 3=$1.1\times10^9$ Ω

Roller NO. 4=$3.0\times10^9$ Ω

The resistances were determined in the manner described above.

Since the present invention includes the feature in the transfer bias setting control, and therefore, an embodiment of the present invention will be described in conjunction with FIG. 2. FIG. 2 shows the V-I characteristics relative to the dark potential $V_D$ portion on the photosensitive drum 1 for the rollers Nos. 1–4, that is the V-I characteristics of the transfer roller when the dark potential portion $V_D$ of the photosensitive drum 1 is in the transfer position, and the transfer operation is not carried out.

In this embodiment, the voltage applied to the transfer roller core metal 6*a* is gradually increased continuously or stepwisely, while the electric current flowing into the photosensitive drum 1 is being detected, in other words, the resistance of the transfer roller 6 is detected. And a point P is determined where the resistance is on a transfer bias setting line represented by $I_T$=f(V) which is predetermined on the basis of experiments or the like. The voltage $V_T$ at this time is held, and this voltage is applied during the transfer operation. This embodiment:

$$I_T=-1.67V_T+7.29$$

Thus, the current $I_T$ is expressed as a one order function. The voltage $V_T$ is expressed in the unit KV, and the current $I_T$ is expressed in the unit of μA.

Figure 3:
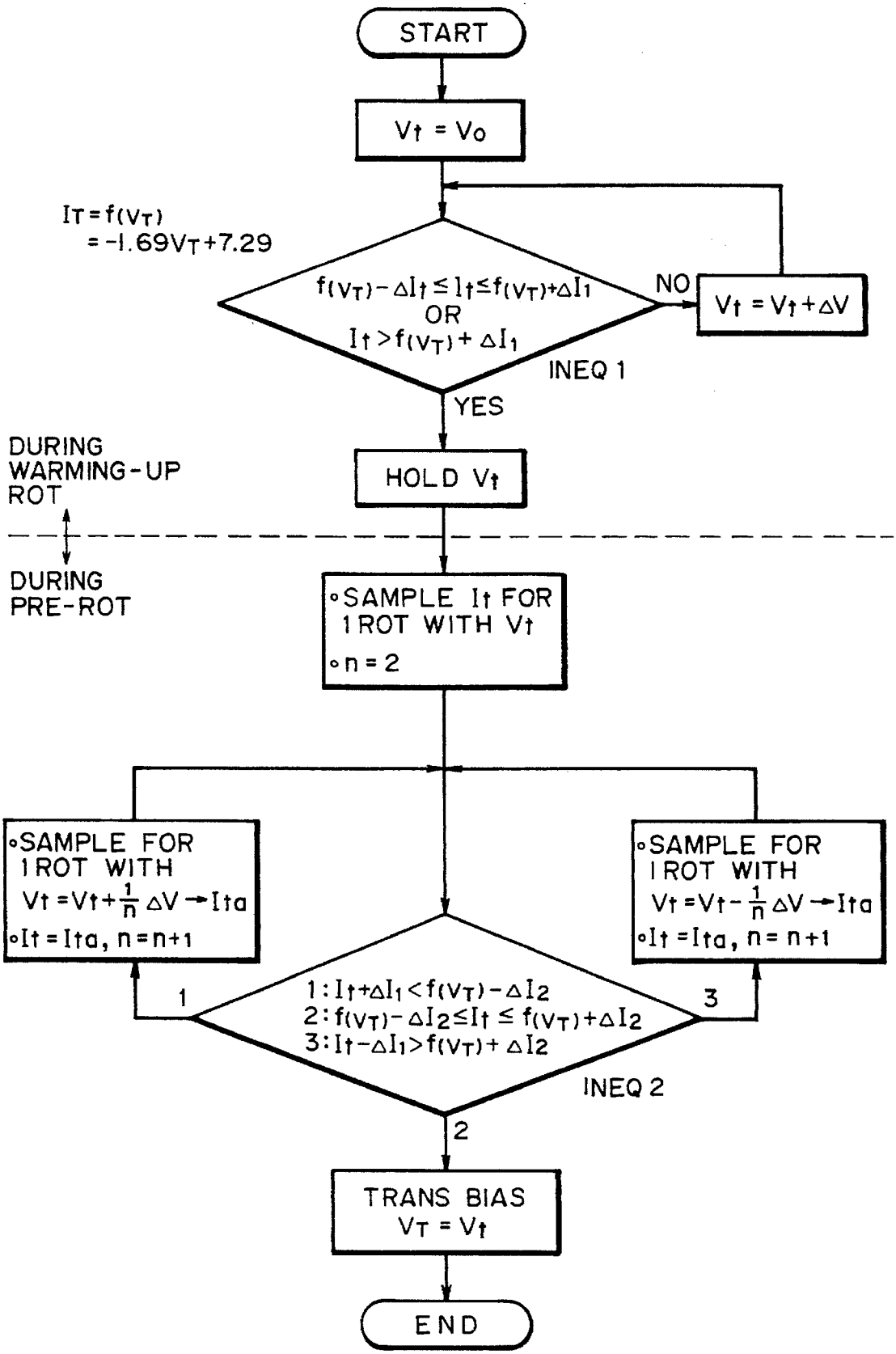
FIG. 3 is a flow chart of sequential operations of the apparatus of this embodiment.

Referring to FIG. 3, there is shown a flow chart or algorithm for obtaining the point P. In the laser beam printer of this embodiment, the switch is actuated, the fixing device is energized first. When the fixing roller is heated to a predetermined temperature (100° C.), the fixing roller is rotated with a pressing roller, and they are stopped when a predetermined temperature (180° C.) is reached. Together with the rotations of the pressing roller and the fixing roller, the photosensitive drum, the charging roller and the transfer roller and the like are also rotated. The rotation is called "warming-up rotation". During the warming-up rotation, the photosensitive drum is cleaned and is electrically discharged. Usually, the warming-up rotation period is normally constant, and in the period, the photosensitive member rotates usually a plurality of turns. After the warming-up rotation is completed, and the fixing device is prepared for start of operation, a print start signal is supplied. Then, the photosensitive drum and the transfer roller or the like start to rotate for the preparation of the printing operation. At this time, the photosensitive drum is charged by the transfer roller. The rotation of the photosensitive drum after the print starting signal to the start of the image forming operation is called "pre-rotation".

In this embodiment, the transfer bias setting operation is such that the resistance of the transfer roller 6 is roughly detected during the warming-up rotation (first detecting mode: rough detection), and during the pre-rotation, the substantially correct P point is detected (second detecting mode: fine detection), so that the transfer bias $V_T$ is finally determined.

The detailed description will be made referring to FIG. 3. In this Figure, the sequential operations other than the transfer operation, such as the primary charging and the developing bias or the like are omitted. As described, the pre-rotation is started immediately before or after the completion of the transfer roller 6 preparation. For the purpose of preparation for the printing operation, the photosensitive drum 1 is subjected to the primary charging operation by the charging roller 2.

To the transfer roller 6, a voltage Vt=V0 is initially applied. Here, V0=1 KV. From the standpoint of reducing the time required for the conversion of the transfer bias voltage to $V_T$, the voltage V0 is preferably high. However, in consideration of the excessive current in the case of the low resistance of the transfer roller, it is preferably 0.8–1.2 KV. When the voltage V0 (=Vt) is applied, the electric current flows from the transfer roller 6 into the photosensitive drum 1. The current It is sampled, and the comparison is made with $f(V_T)$ on the transfer bias setting line. As for the detecting point for the current It, it may be an inlet portion of the electric current to the transfer roller 6 from the voltage source side.

During the sampling period, the rough detection is carried out, and therefore, the sampling period is not required to be as long as one full turn of the transfer roller. In consideration of the converging period to the voltage $V_T$, it is ⅛–¼ full turn of the transfer roller (0.15–0.25 sec) in this embodiment. The comparison is made in consideration of the sampling error $\Delta I_1$, and the applied voltage is increased by $\Delta V$ until the following is satisfied:

$$f(V_T)-\Delta I_1 \leqq It \leqq f(Vt)+\Delta I_1 \qquad \text{Inequation 1}$$

where $\Delta I_1$ is 0.5 μA, and $\Delta V$ is 200 V. When the voltage is gradually increased, the above inequation will become satisfied. Then, the voltage Vt is held, and the voltage level is stored until the next pre-rotation is carried out.

The warming-up rotation will be carried out immediately after recovery of jam, and in that case, the sheet is automatically discharged, and therefore, the warming-up rotation period is long enough to discharge the transfer material to the outside of the apparatus. Therefore, the warming-up period is long enough to execute the above-described sequential operations. Even in the case of the roller No. 4 which is considered to require the longest period, the final voltage Vt is obtained within 10 sec.

The description will be made as to the pre-rotation at time of the printing operation. Since the voltage level Vt for flowing the current It (FIG. 2) which is close to $I_T$ on the transfer bias setting line, has been obtained during the warming-up rotation. Therefore, the precise current level is determined during the pre-rotation.

The inequation for the pre-rotation in FIG. 3 is so determined. The voltage level Vt obtained in the warming-up rotation is applied during the pre-rotation to all the portions of the roller outer surface. If the resistance of the transfer roller has an unevenness in the circumferential direction, the current level changes while the transfer roller 6 rotates, and therefore, the current It is liable to be slightly deviated from the following inequation:

$$f(V_T)-\Delta I_1 \leqq It \leqq f(Vt)+\Delta I_1$$

The inequation (2) during the pre-rotation is determined in consideration of the deviation. In this embodiment, the current level $I_T$ for setting the transfer bias is determined with the following margin:

$$\Delta I_2=0.2\ \mu A$$

in the inequation of $f(V_T)-\Delta I_2 \leqq I_T \leqq f(V_T)+\Delta I_2$ . . . inequation 2.

The applied voltage Vt is increased or decreased until the inequation is satisfied. Depending on the situation, the sequential operations branch to the steps 1, 2 and 3. When the inequation is satisfied, the voltage Vt is determined as the final transfer bias voltage $V_T$. The sampling period during the pre-rotation for the voltage Vt is as long as one half or one full periphery of the transfer drum in order to increase the detection accuracy (0.6–1.2 sec). Even if the relatively long period is used, the voltage is converged in a short period because the current level It is fairly close to the current It. In the experiments of this embodiment, for the rollers Nos. 1–4, the voltage was converged in 3–4 sec.

The description will be made as to how to determine the transfer bias setting line $I_T=f(V_T)$ used in this embodiment. The current through the transfer material P with which the good print is provided with high transfer efficiency, is determined in the laser beam printer used in this embodiment.

Figure 4:
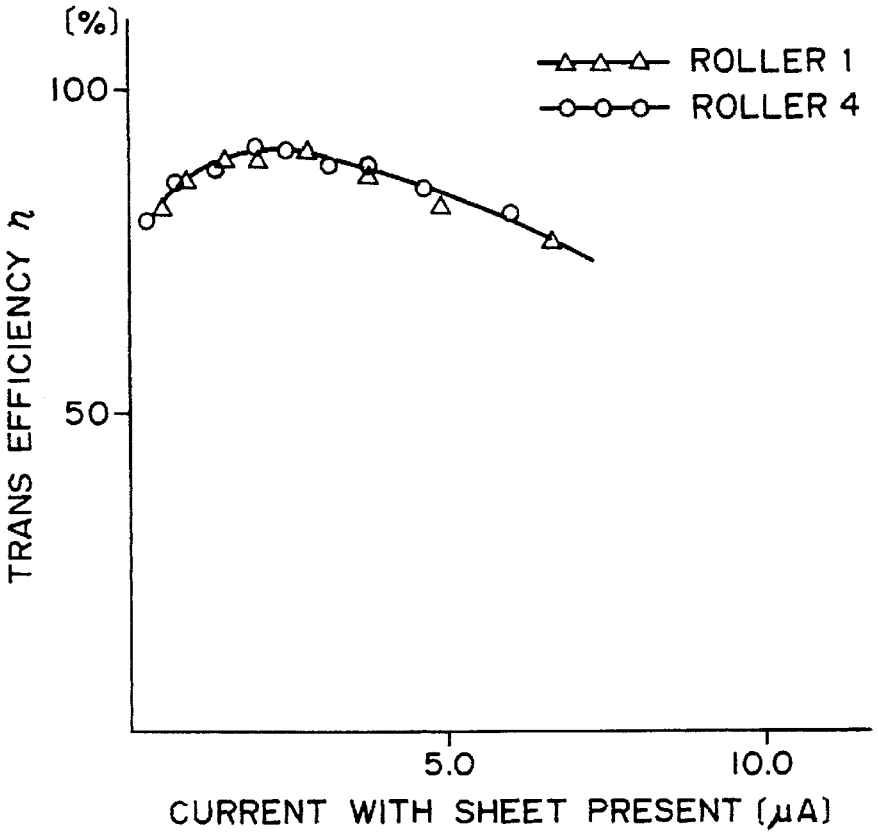
FIG. 4 is a graph of image transfer efficiency vs. electric current when the transfer material is present in the transfer station.

FIG. 4 is a graph of image transfer efficiency η with the current through the sheet (transfer current) when the resistance of the transfer roller 6 is changed, under the N/N condition. The basis weight of the transfer material was 75 g/m$^2$ (available from Xerox Corporation, 4024). The transfer efficiency is determined with the use of a reflection type density meter.

From FIG. 4, it is understood that the transfer efficiency has a peak at the current of approx. 1.5–3.0 μA in the laser beam printer. The coincidence of the peak irrespective of the level of the transfer roller resistance supports the dependency of the transfer efficiency on the current through the transfer material not on the resistance or the applied voltage.

Next, the relation between the electric current flowing into the dark potential portion $V_D$ of the photosensitive drum 1 with a certain level of a voltage when the image transfer operation is not carried out, and a transfer efficiency when the same voltage is applied during the subsequent transfer operation. The relations were determined when the resistance of the transfer roller is high and low.

Figure 5:
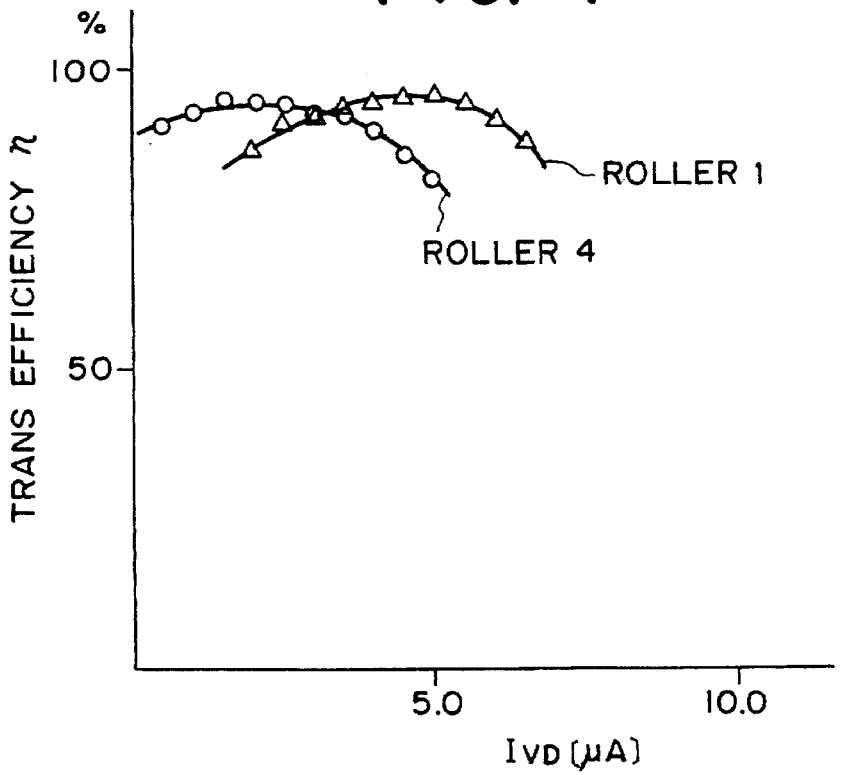
FIG. 5 is a graph of image transfer efficiency vs. electric current flowing into the dark portion area of an image bearing member.
Figure 10:
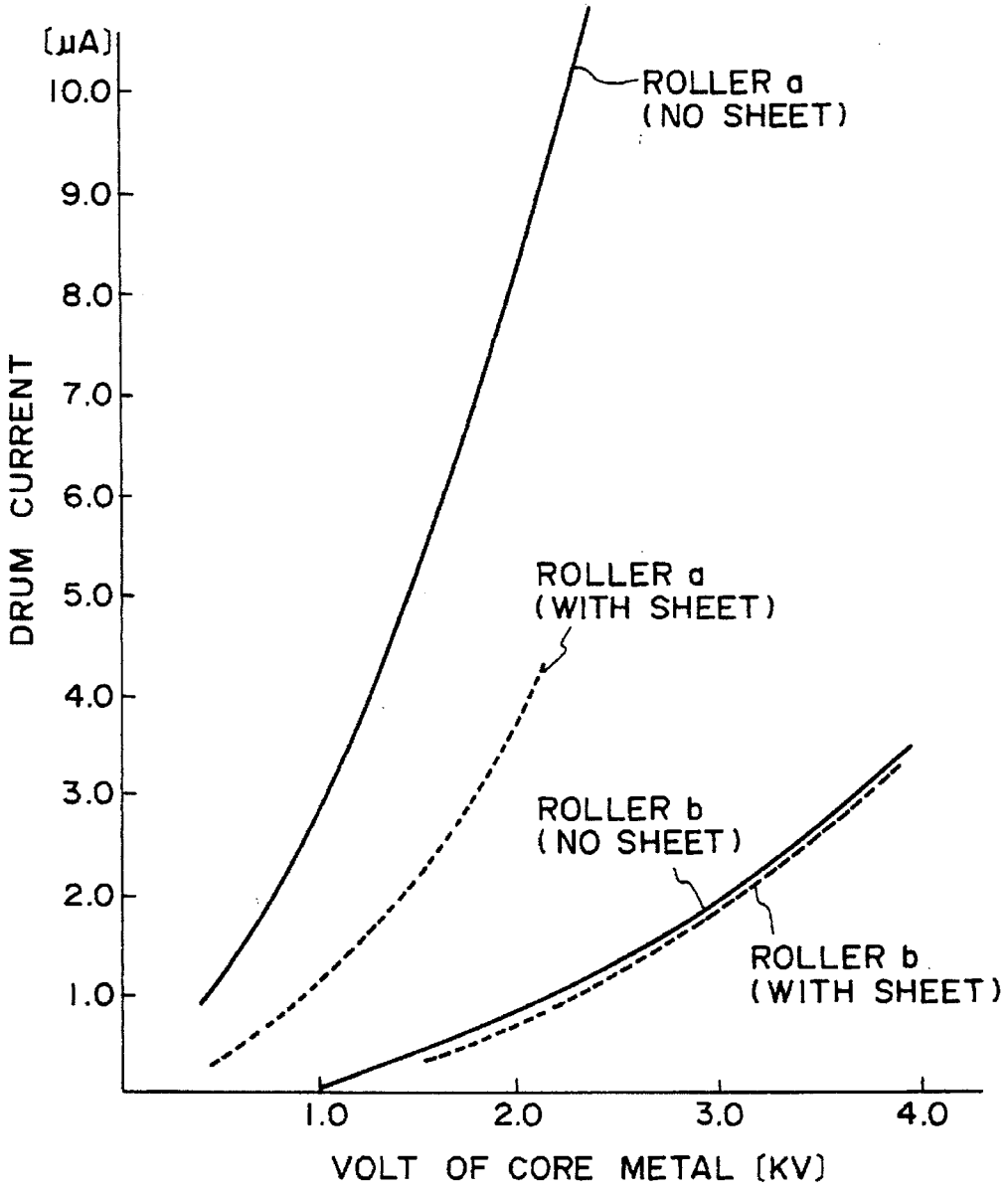
FIG. 10 is a graph of voltage-current characteristics (V-I curves) when the transfer material is present and absent in the transfer station, in the case of the transfer roller used as the transfer member.

FIG. 5 shows a relation between the transfer efficiency η and the current flowing into the dark potential portion. In this graph, the peaks of the transfer efficiency of the rollers Nos. 1 and 4, are different. As has been described in conjunction with FIG. 10, in the case of the roller No. 4 having a relatively high resistance, the resistance of the roller itself is ruling irrespective of the presence or absence of the transfer material between the transfer roller and the photosensitive drum, therefore, the electric current flowing into the photosensitive drum is substantially constant. Therefore, the peaks of the transfer efficiency are substantially the same, as will be understood when the roller 4 in the graph of FIG. 4 (with the sheet) and the graph of FIG. 5 (without the sheet), are noted. The peak is:

1.5–3.0 μA

On the other hand, in the case of the low resistance roller such as the roller No. 1, the resistance of the transfer material rather than the resistance of the roller itself is ruling, and therefore, the current ($I_{VD}$) without the transfer material is larger than the current without the transfer material, under the same voltage condition. Therefore, in order to flow the current of 1.5–3.0 μA providing the peak transfer efficiency during the transfer operation with the sheet or transfer material present, it will be understood that the voltage is so high that the current of 4.0–6.0 μA flows through the non-sheet portion. In order to maintain the peak of the transfer efficiency irrespective of the electric resistance of the transfer roller, it is desirable that the transfer current of 1.5–3.0 μA is provided by constant control when the sheet is present in the transfer position.

However, when the contact type transfer means such as the transfer roller is subjected to the constant current control, as has been described hereinbefore, more electric current flows into the bare photosensitive member side than to the transfer material when the size of the transfer material is small. If this occurs, the voltage drops, and therefore, the electric charge supplied to the backside of the transfer material becomes insufficient. Accordingly, the constant voltage control is required to stabilize the transferred image. The function $I_T=f(V_T)$ is determined in consideration of the above-described characteristics, so that when the low resistance transfer roller is used, the electric current flowing to the dark potential portion is made larder and that when the roller has a high resistance, it is made smaller. By setting in this manner, the current flowing to the transfer material can be properly controlled whatever resistance the transfer roller has.

In this embodiment, the rough control under the fine control are effected during the warming-up rotation and pre-rotation periods, respectively, for the following reasons. The warming-up rotation is carried out after the power supply is started, and usually it takes place under unstabilized conditions, that is, the first time in the morning. Therefore, the resistance detection is also carried out in that detection during the warming-up rotation. Since the ambient conditions such as the room temperature and the humidity gradually changes in the office or the like, and therefore, the proper transfer conditions will also change from the state under the morning condition. Under the circumstances, the fine control is effected during the pre-rotation period immediately before the printing operation, and the bias voltage is determined on the basis of the fine control, and therefore, the good image transfer operation can be carried out.

Durability test run under different ambient conditions were carried out using the laser beam printer and rollers Nos. 1–4 in which a constant transfer bias voltage $V_T$ was applied between the roller and the drum. It has been confirmed that even if the resistance of the roller itself varies, the proper transfer bias can be always provided because of the above-described sequential operations, and therefore, the proper transfer operations could be continued. In addition, it has been confirmed that a wider variety of resistances of the transfer roller are usable.

Figure 6:
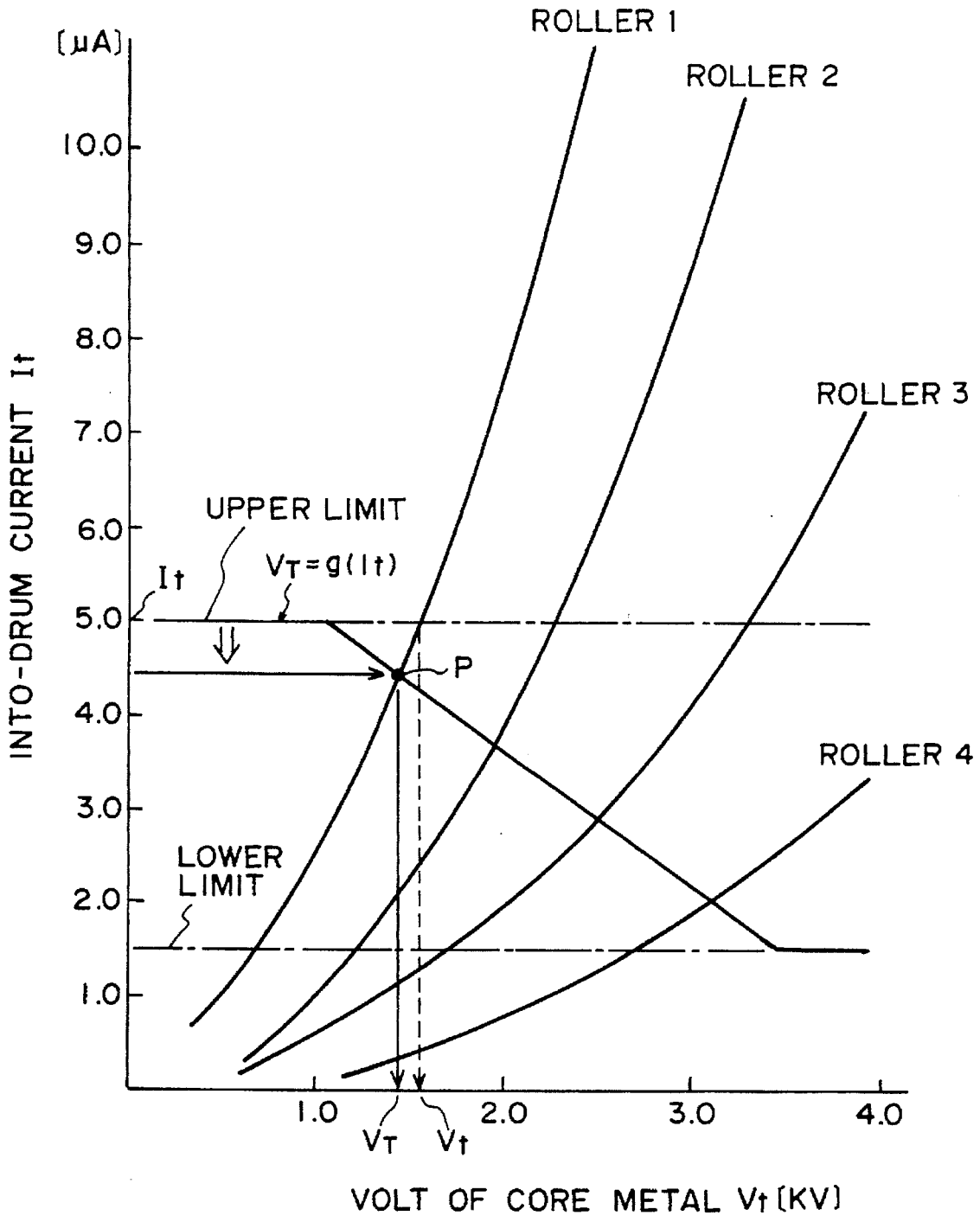
FIG. 6 is a graph of V-I curves explaining the principle of resistance measuring mode in an apparatus according to a second embodiment of the present invention.

Referring to FIG. 6, there is shown a control system according to a second embodiment of the present invention. In this embodiment, the electric current $I_T$ flowing into the photosensitive drum is made variable in obtaining an intersection P between the transfer bias setting line $V_T=g(I_T)$ and the V-I curve of the transfer roller. In place of the electric current $I_T$ flowing into the drum, the electric current flowing from the voltage source to the transfer roller is usable.

In the variable voltage system described in Embodiment 1, if the resistance of the transfer roller is extremely low, a relatively low voltage such as 1.0 KV would result in the extremely large electric current for the photosensitive drum. If this occurs, the photosensitive member receives the electric charge of the polarity opposite from that of the primary charge particularly in the case of reverse development apparatus, with the result of the damage to the photosensitive member. If the opposite charging of the photosensitive drum is not recovered by the next primary charging to which the photosensitive member is subjected to, the non-image portion receives the developer in the developing step and appears has a foggy background in the printed image. In consideration of this, the sampling operations in modes 1 and 2 during the absence of the transfer sheet, are preferably started after such a portion of the photosensitive drum 1 as has been subjected to the primary charging operation is brought into contact to the transfer roller.

In this embodiment, in order to avoid the above risk, the electric current is changed within actually practically transfer current range to detect the intersection P.

As described in conjunction with Embodiment 1, the good transfer condition exists in the range of 1.5–3 μA of the transfer material passing current, and therefore, the minimum of the into-drum-current $I_T$ is selected to be 1.5 μA, that is, the lower limit is 1.5 μA. The upper limit is selected to be 5 μA which does not damage the photosensitive drum. Within this range, the current $I_T$ is changed. The upper limit of 5 μA is determined in consideration of the process speed and the material of the photosensitive member. In the laser beam printer used in this embodiment, this is the upper limit. The direction of the change of the current $I_T$ may be from 1.5–5.0 μA (increasing direction) or may be from 5.0–1.5 μA (decreasing direction). In this embodiment, the decreasing direction from 5.0 μA was selected.

Figure 7:
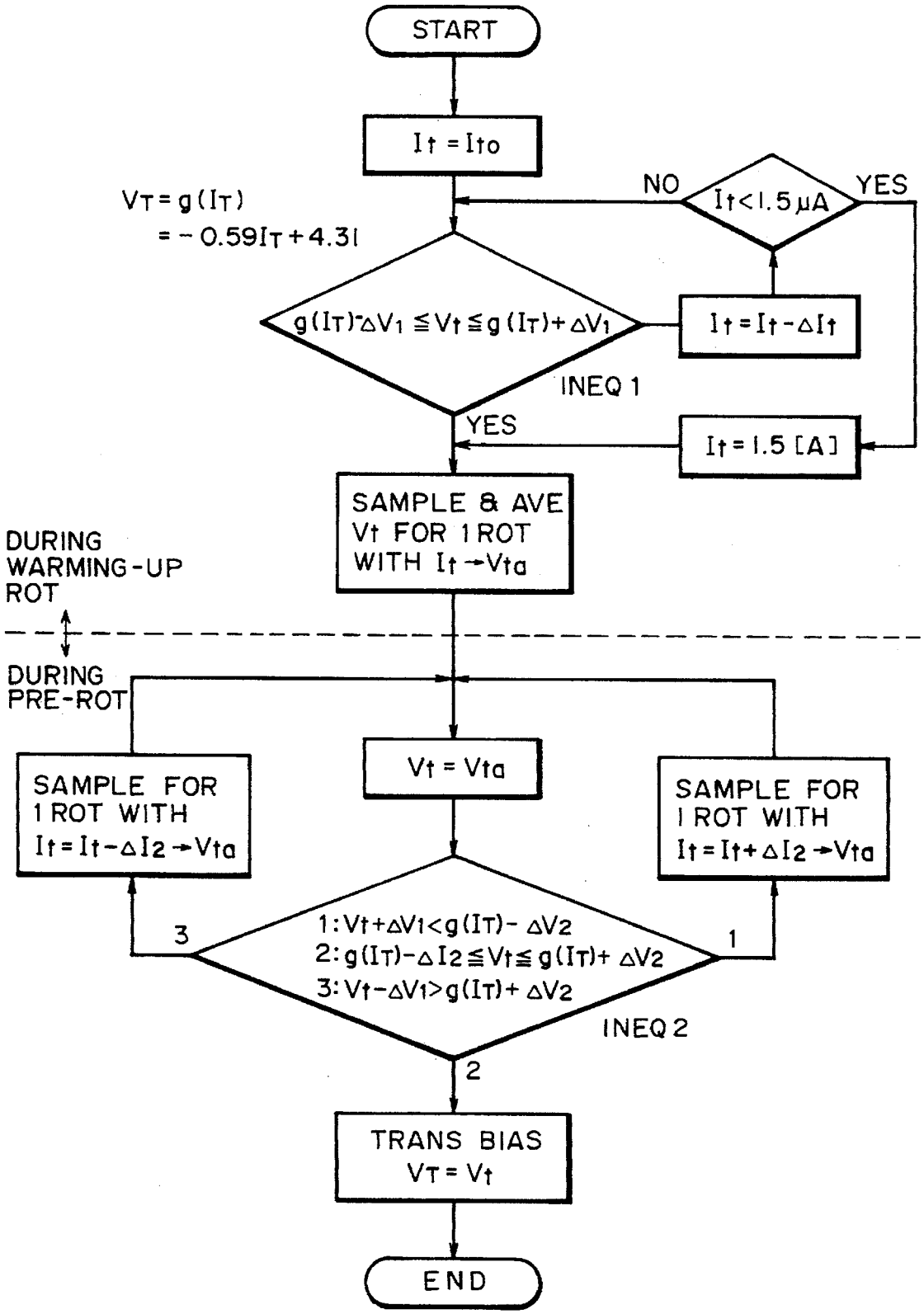
FIG. 7 is a flow chart of sequential operations in the apparatus of the second embodiment.

FIG. 7 shows the sequential operations of this embodiment. Similarly to the first embodiment, the fine control (second detecting mode) is carried out during the warming-up period to detect fairly correct resistance is detected, and is used for the voltage application.

The transfer bias setting line in this embodiment is:

$$V_T=g(I_T)0-0.59I_T+4.31V_T\text{: } KV\ I_T\text{: } \mu A$$

In FIG. 7, during the warming-up rotation period, the detecting current is set Ito=5.0 μA and was decreased with increment of $\Delta I_1=0.3$ μA, and the produced voltage $V_T$=detected. The voltage $V_T$ is determined as an average of the sampled data over ¼ peripheral surface of the roller. When the voltage $V_T$ satisfies the following inequation 1:

$$g(I_1)-\Delta V_1 \leqq V_T \leqq g(I_T)+\Delta V_1 (\Delta V_1=250\ V)$$

the voltage sampling operation is carried out for one full turn of the roller with the electric current $I_T$ at that time, and the produced voltages $V_T$ are averaged into Vta, which is held.

During the actual printing operation, the pre-rotation is started. The held voltage Vta is discriminated using the inequation 2. If the voltage does not satisfy the condition, the sequential operation branches out to line 1 or line 3 to change the current $I_T$ again effect the fine control. In this example, the electric current is changed with the increment of $\Delta I_2$=0.1 μA, and the voltages are sampled for one full turn of the roller with the current $I_T$ to determine the average voltage Vta, again.

When the held voltage Vta satisfies the inequation 2, the voltage is applied to the transfer roller as the transfer bias $V_T$.

When the current $I_T$ is lower than 1.5 μA, the current $I_T$=1.5 μA is automatically selected, and therefore, the voltage Vta is determined as the transfer bias voltage $V_T$. The constant voltage application operation is effected between the photosensitive drum and the transfer roller with the transfer bias voltage $V_T$.

Even in the case of this embodiment in which the current is changed, the transfer bias $V_T$ is determined in substantially the equivalent time period, with the same advantageous effects. In addition, since the current control is used, the risk of damaging the photosensitive drum is small, and the highly reliable control is possible.

A third embodiment of the present invention will be described in which there is provided a mode in which the contact transfer member is cleaned during the warming-up rotation period. In the laser beam printer having the contact type transfer member which is contacted to the backside of the transfer material, a cleaning mode is generally provided in consideration of the contamination of the transfer member with toner or the like when the jam of the transfer material occurs. The cleaning operation is carried out usually during a post-rotation period after the completion of the printing operation. Usually, during the cleaning operation, the contact transfer member is supplied with a bias voltage having the same polarity as the toner, that is, the opposite polarity from that of the transfer bias voltage. In consideration of the fact that when the jam occurs, the apparatus is removed after the main switch is once turned off, the cleaning operation is also carried out during the warming-up rotation period. The cleaning mode operation is carried out while the transfer material is absent in the transfer position, so that the toner particles deposited on the transfer roller are transferred back to the photosensitive drum.

If the detecting mode (rough control) as in Embodiments 1 and 2 is carried out after the cleaning operation is performed, or if the cleaning mode operation is carried out after the first mode control operation is carried out, the warming-up rotation period is very long with the result of long waiting period.

In this embodiment, in order to avoid such a problem, the cleaning mode operation and the detecting mode operation 1 are simultaneously carried out. Such a simultaneous operations are possible because the charging properties of the contact charging means are not different depending on the polarity of the bias voltage.

The laser beam printer shown in FIG. 1 has a cleaning mode in which −1.5 KV bias voltage is applied to the core metal 6*a* of the transfer roller for 4 sec. The value of the bias voltage during the cleaning mode and the cleaning period are influential for the cleaning performance as independent factors. If the bias voltage is high, the time period required for the cleaning is short, but if it is too high, it will charge the toner to the opposite polarity with the result of insufficient cleaning action. If it is too low, the amount of the toner remaining on the transfer roller increases. If this occurs, the toner is transferred back to the backside of the transfer material during the transfer operation with the result of contamination of the back face of the transfer material. The longer cleaning period is preferable from the standpoint of good cleaning, but the long period cleaning operation will be influential to the throughput. If it is too short, the backside contamination of the transfer material will be brought about. Therefore, there would be a proper bias and a proper time period. In this embodiment, it has been found that the combination of −1.5 KV and 4 sec is most efficient for the cleaning operation.

Figure 8:
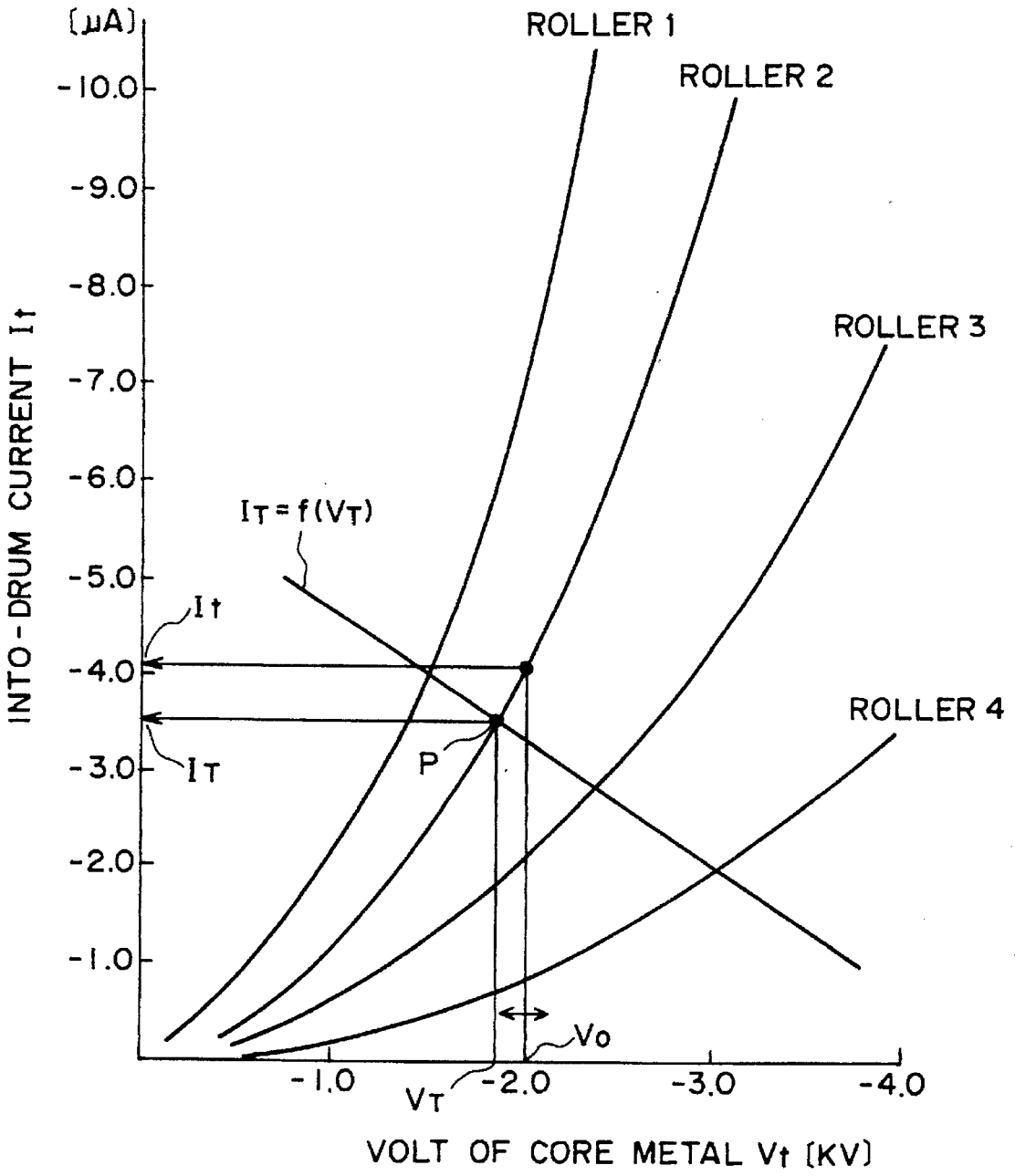
FIG. 8 is a graph of V-I curves for explaining the principle of the resistance measuring mode in an apparatus according to a third embodiment of the present invention.

Referring to FIG. 8, the description will be made as to a feature of this embodiment. FIG. 8 is a graph of V-I curve relative to the ground level (0 V) of the photosensitive drum. The transfer roller is the same as in Embodiments 1 and 2, that is, the foamed EPDM roller. The line of $I_T=f(V_T)$ is the transfer bias setting line in this case, and has been so corrected that the good bias voltage can be obtained when the transfer roller is controlled with the absolute values of the voltage $V_T$ and the current $I_T$. The function of the corrected line is expressed as follows:

$$I_T=f(V_T)=1.33V_T-6.0 \ (I_T\text{: } \mu A,\ V_T\text{: } KV)$$

Therefore, the control is carried out with the negative bias also in the second detection mode, and finally, it is converted to a positive bias when used as the transfer bias.

Figure 9:
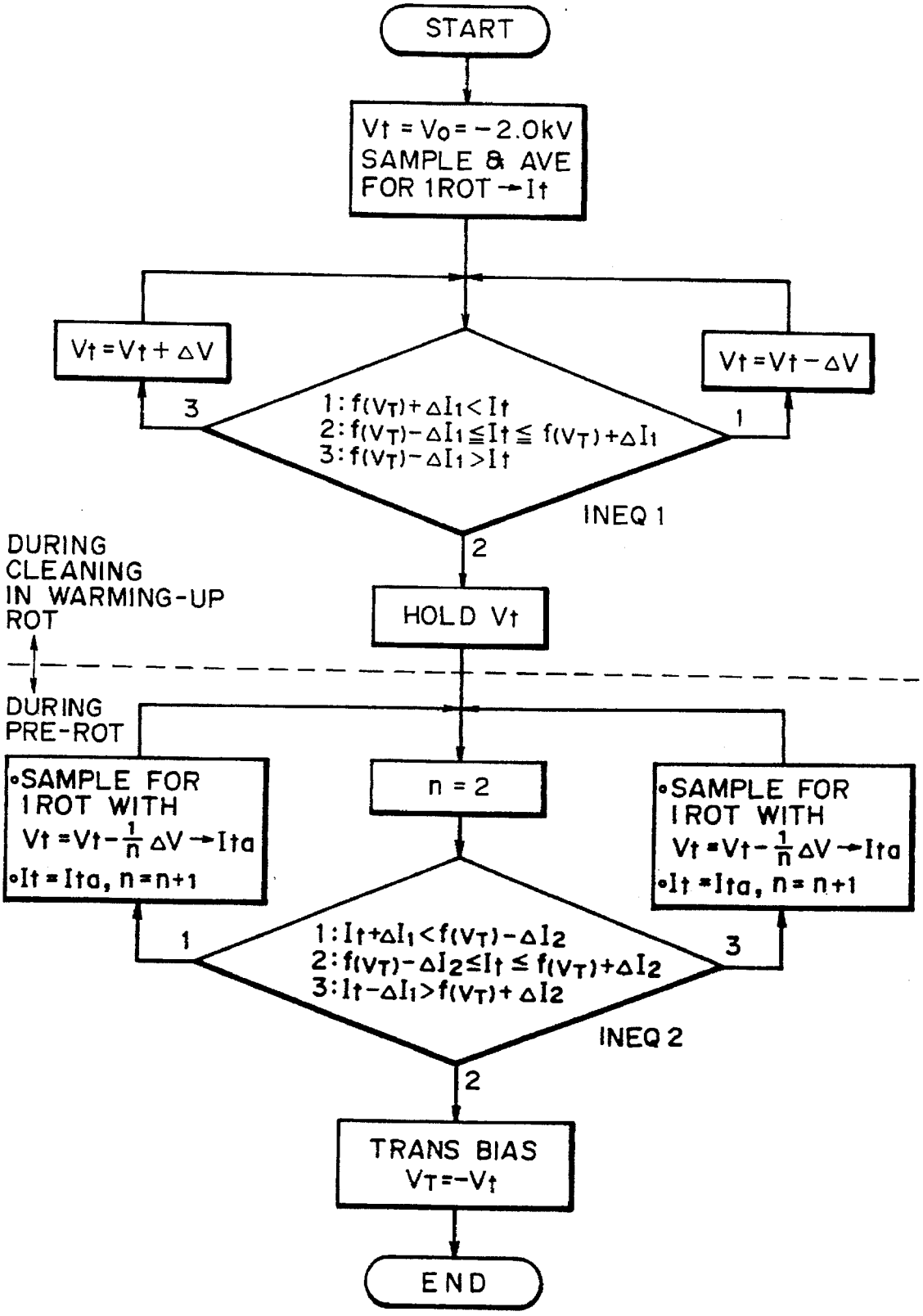
FIG. 9 is a flow chart of sequential operations in the apparatus of the third embodiment.

Referring to FIG. 9, the sequential operation of the apparatus of this embodiment will be described. In this embodiment, the voltage applied to the core metal 6*a* of the transfer roller is set to −2.0 KV, and the sampling is effected for one full turn of the roller (It). During this period, almost all of the toner particles deposited on the transfer roller are transferred back onto the photosensitive drum. There has been no significant difference between the sampling of the current It while the toner particles are deposited on the transfer roller and the sampling of the current It without the toner particles deposited thereon. It is considered that this is because when the toner is transferred onto the drum by the electric field, the electric charge is also transferred. Thereafter, the voltage Vt is changed with the increment of ΔV=200 V, and the operations are repeated, until the condition is satisfied. At the time when the condition is satisfied, it has been confirmed that no toner particles are deposited on the transfer roller. This is considered to be because the initial setting voltage Vb is as high as −2.0 KV, and therefore, most of the toner particles are transferred back onto the photosensitive drum when the current It is sampled while the voltage is about V0. The sampling period of the current It at this time corresponds to one fourth the roller periphery. When the condition is satisfied, the voltage Vt is held.

The detecting mode 2 (fine control) is similar to that of Embodiment 1, and therefore, the detailed description is omitted. However, it should be noted that the transfer bias voltage $V_T$ is obtained by converting the obtained bias voltage Vt into a positive value.

According to this embodiment, the operation of this invention is effected during the cleaning mode in the warming-up rotation period, and therefore, the waiting period is not increased by an expanded warming-up period. The advantageous effects of Embodiments 1 and 2 are also provided, and therefore, the stabilized image transfer operations are possible.

A fourth embodiment of image transfer bias control system will be described. In this embodiment, the fundamental structure or operation of the image forming apparatus are the same as in FIG. 1 apparatus, and therefore, the detailed description thereof are omitted for simplicity.

Figure 11:
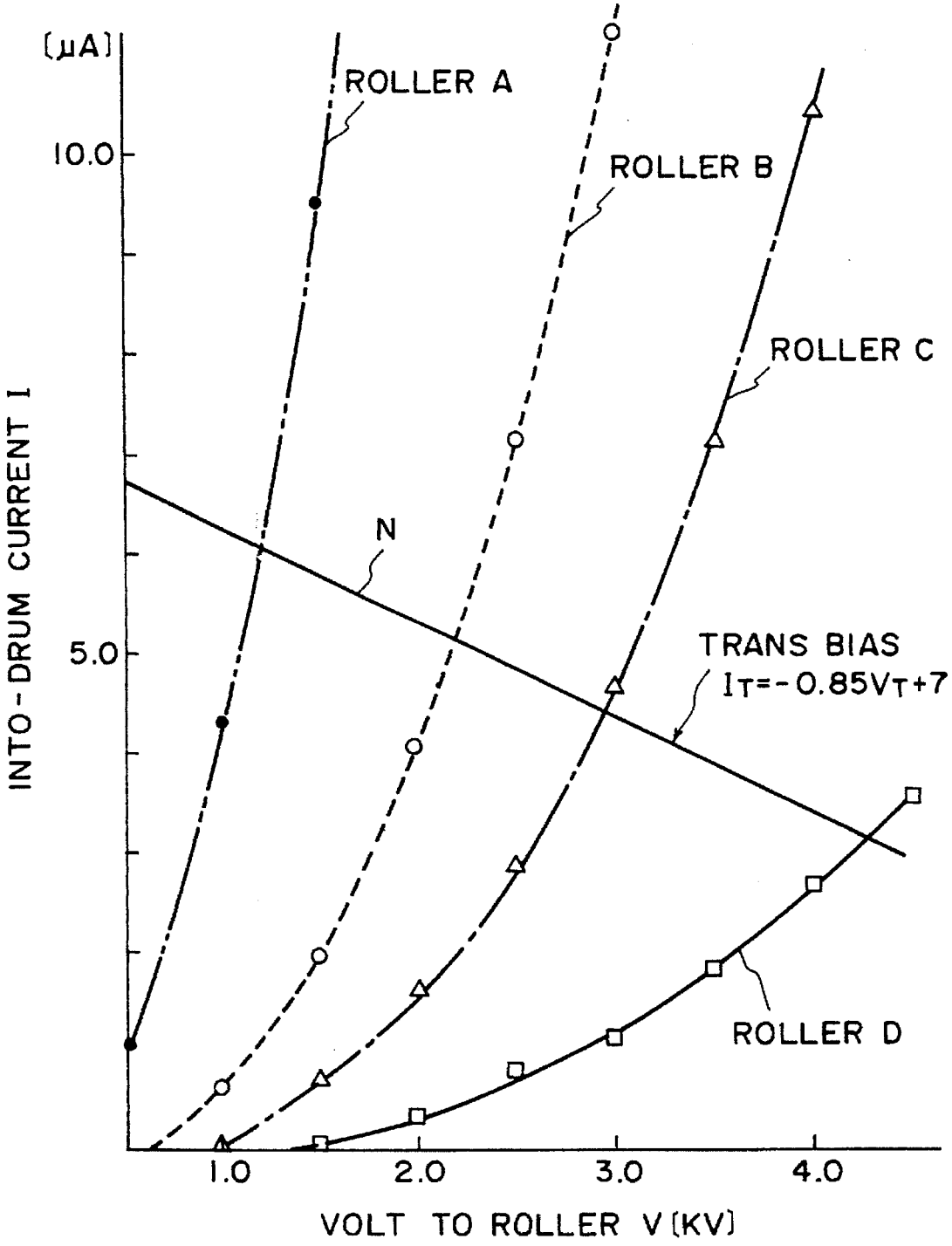
FIG. 11 is a graph of voltage-current curves of the transfer roller.

FIG. 11 is a graph of V-I curves for image transfer rollers A–D having the following resistances:

Roller A=$1.0\times10^8$ Ω

Roller B=$5.0\times10^8$ Ω

Roller C=$1.0\times10^9$ Ω

Roller D=$5.0\times10^9$ Ω

The resistances are relative to the dark portion potential $V_D$ (=−600 V) on the photosensitive member. The resistances are measured in the manner described in the foregoing.

In the graph of FIG. 11, a solid straight line N represents the relation between the voltage and the current for setting the transfer bias. The transfer bias setting line is obtained as plots of maximum transfer efficiency for each of the transfer rollers when images are actually printed with varied resistance of the transfer roller. The relation between the voltage and current of the transfer bias setting line in FIG. 11 is:

$$I_T=-0.85V_T+7 \quad (I_T:\mu A,\ V_T:\ KV)$$

Figure 12:
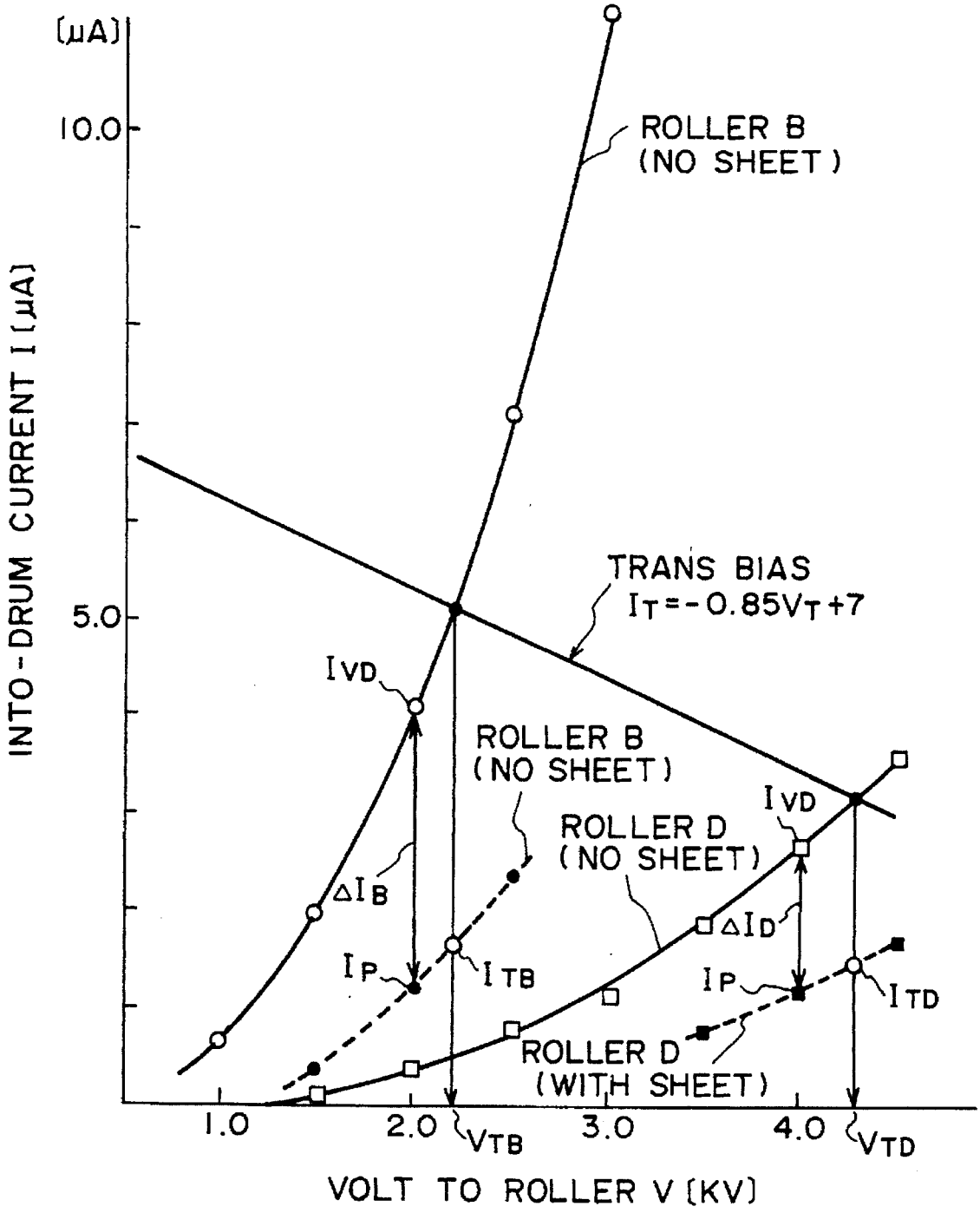
FIG. 12 is a graph of electric current which flows in the presence or absence of the transfer material in the transfer station.

Referring to FIG. 12, the description will be made as to the reason why the transfer bias setting line takes this shape. FIG. 12 is a graph of V-I curves for the transfer rollers B and D, and the solid lines are for sheet absent mode, that is, relative to the dark portion potential $V_D$ (−600 V); and the broken lines are for transfer materials.

As will be understood from FIG. 12, when the transfer rollers B and D are compared, the difference $\Delta I=I_{VD}-I_P$ between the current $I_{VD}$ during the sheet absent period and the current $I_P$ with the sheet present is different. This is because when the resistance of the transfer roller is relative low, the load from the core metal of the transfer roller to the photosensitive member changes significantly depending on the presence or absence of the transfer material, whereas when the resistance is relatively high, the change of the load is small. In view of this, in order to provide a voltage necessary for flowing the electric current during the passage of the transfer material irrespective of the difference of the resistance of the transfer roller from that before the transfer operation, it is desirable that the electric current flowing into the dark potential portion $V_D$ is relatively large when the resistance is relatively low, whereas when the resistance is relatively high, the current flowing into the dark potential portion $V_D$ is relatively small. For this reason, the transfer bias setting line is inclined downward toward the right on the V-I characteristic graph of FIG. 12.

In this embodiment, the voltage applied to the transfer roller during the sheet absent period before the start of the image transfer operation is gradually increased, and the electric current flowing into the photosensitive member is monitored to determine the V-I curve. An intersection of the curve with the following transfer bias setting line is obtained:

$$I_T=-0.85V_T+7$$

The voltage $V_T$ at the intersection is held, and the voltage $V_T$ is applied between the roller and the drum as the constant voltage when the transfer material passes through the transfer position.

Referring to FIG. 12, when the printing operation is effected with each of the rollers while the voltage of the transfer roller B is maintained at $V_{TB}$ and while the voltage of the transfer roller D is maintained at $V_{TD}$, the electric current $I_{TB}$ and $I_{TD}$ flow through the transfer material in the rollers B and D, respectively.

As for the means for changing the voltage applied to the transfer roller, the signal from the DC controller by way of the D/A converter is continuously increased. In this embodiment, a PWM (pulse width modulation) system is used.

Figure 15:
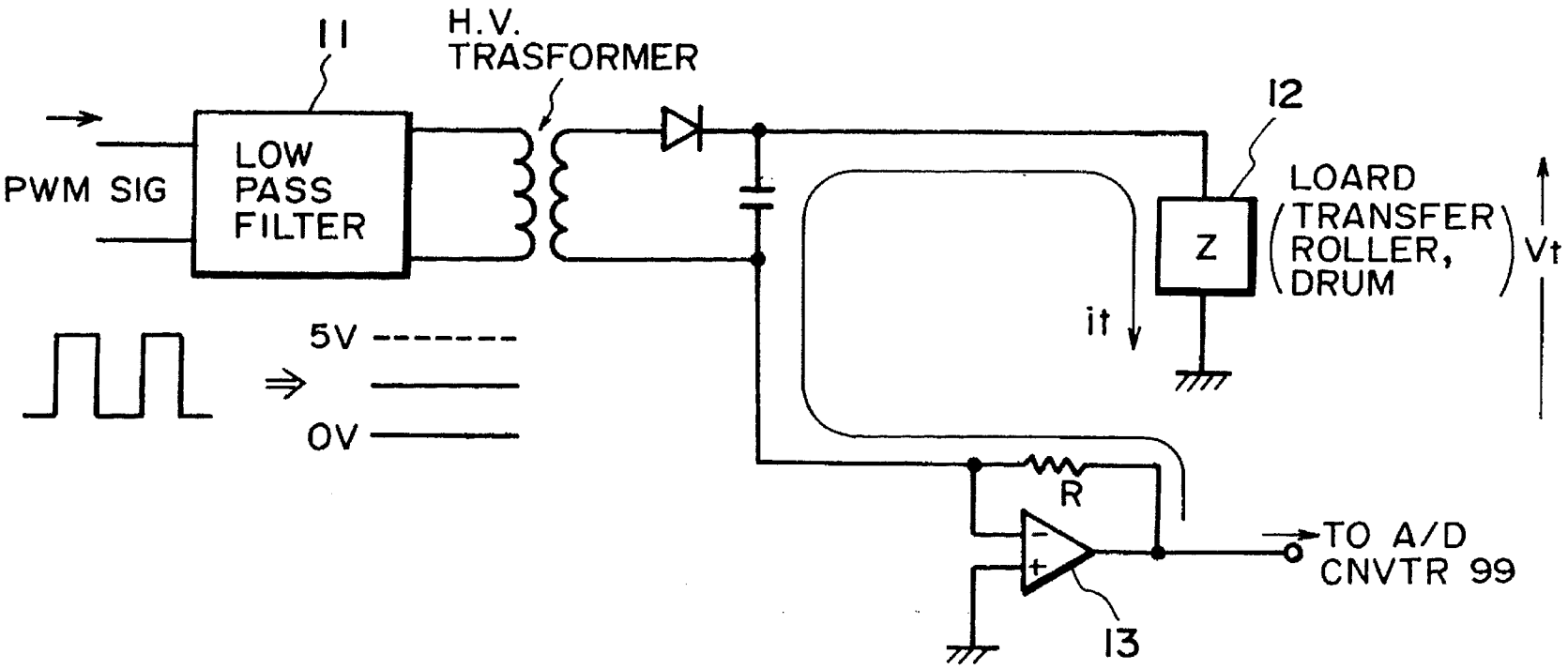
FIG. 15 is a circuit diagram of a transfer high voltage control circuit.

FIG. 15 shows an example of a transfer high voltage control circuit. A PWM signal produced by the DC controller 10 shown in FIG. 1 is passed through a low pass filter 11 disposed at a primary side of a high voltage transformer 41, by which the signal is converted to 0–5 V level signal. Subsequently, the voltage level is changed to a transfer bias voltage level. A signal corresponding to the electric current at this time is supplied to the CPU.

Thus, a duty ratio of the pulse signal is modulated in response to the PWM control, by which the voltage of the low pass filter 11 is changed, and the generated voltage is changed accordingly.

Figure 13:
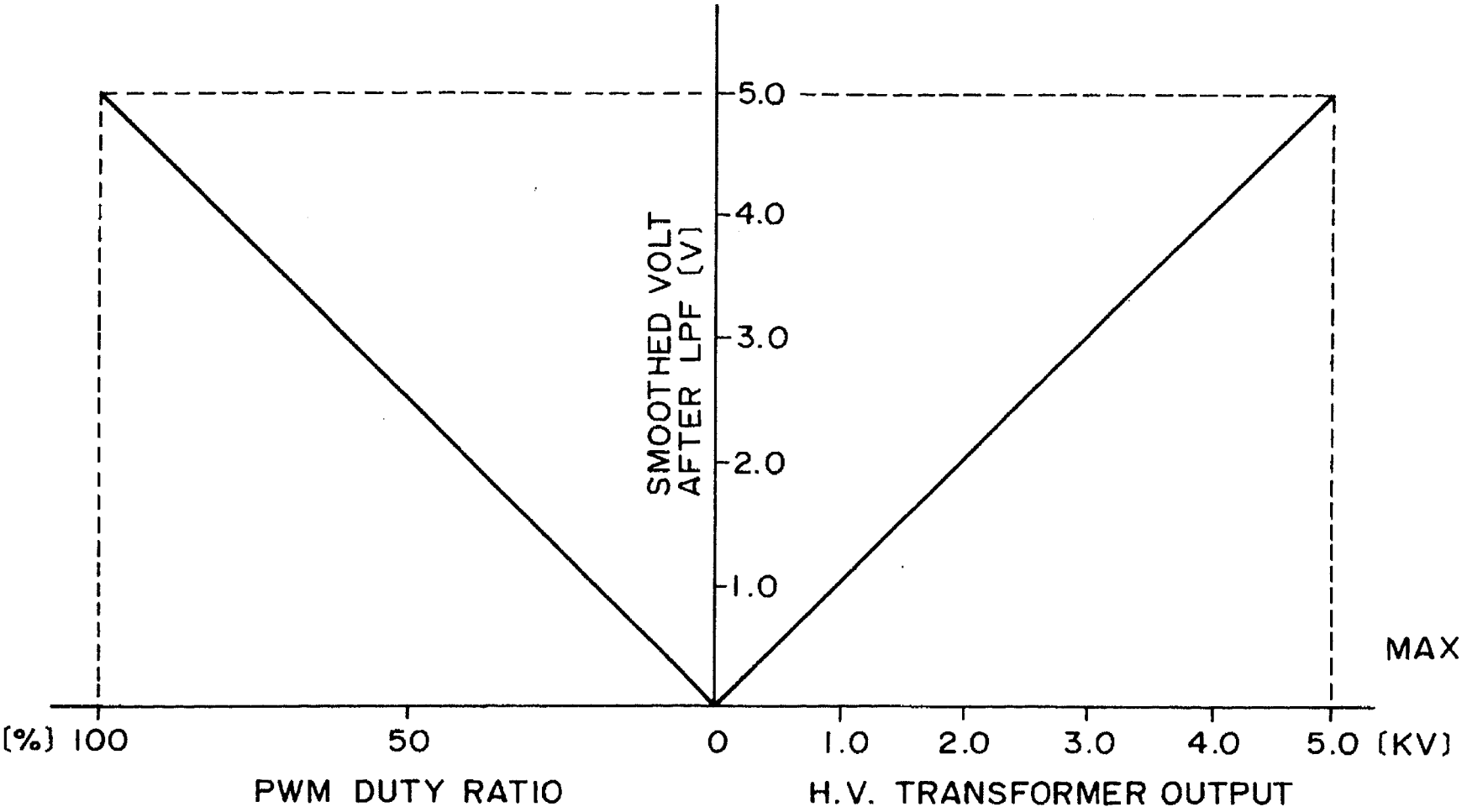
FIG. 13 is a graph showing a relation between the duty ratio of the PWM (pulse width modulation) control and the produced voltage.

The description will be made further referring to FIGS. 13 and 14. FIG. 13 shows a relation between a generated (output) voltage (hardware) responsive to the duty ratio (software) of the PWM control.

Since the maximum output voltage of the transfer high voltage transformer of the laser beam printer according to this embodiment, is 5.0 KV, the voltage 5.0 KV is outputted when the duty ratio of the PWM is 100%. The duty ratio of the PWM control has the resolution of 256 bits, and the duty ratio may be increased bit by bit, in which 1 bit corresponds to approx. 20 V. The resolution is high enough for the transfer high voltage. The high resolution is one of the characteristics of the PWM control.

Figure 14:
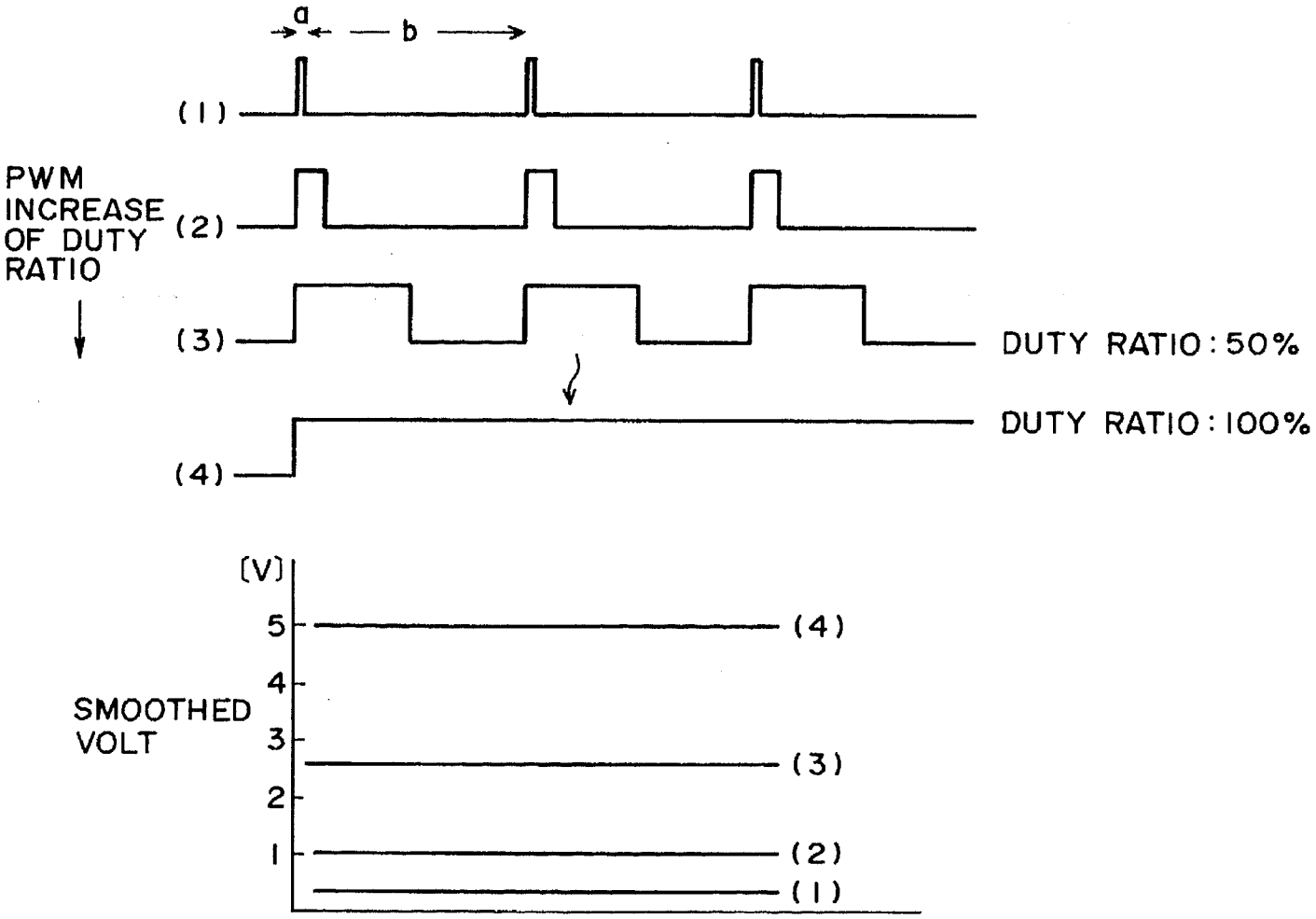
FIG. 14 is a graph showing increase of the duty ratio of the PWM control.

FIG. 14 schematically shows increase of the duty ratio of the PWM control, so that the voltage is increased. In FIG. 14, (1) a:b represents the duty ratio. From this level, the duty ratio is gradually increased, that is, the number of bits is increased, until the voltage of the transfer bias setting line is reached. The PWM controlled signal is provided in the DC controller 10 in FIG. 1. The signal is supplied to the high voltage control circuit shown in FIG. 15.

In accordance with the change of the PWM signal, the output voltage also changes, and therefore, the electric currents i flowing to the transfer roller or photosensitive member (load 12) also changes. The electric current i is converted to a voltage by a voltage converting circuit 13, and is fed back through an A/D converter 9*a* to the DC controller 10.

In the DC controller 10, the discrimination is made as to whether the relation between the PWM signal and the voltage, that is, the relation between the voltage applied to the transfer roller and the current flowing into the drum is the same as the V-I relation of the transfer bias setting line or not. If not, the duty ratio of the PWM signal is continued to increase until they become the same.

The voltage (PWM signal level) when they become the same, is held, and it is applied when the transfer material is passed through the transfer position.

Figure 16:
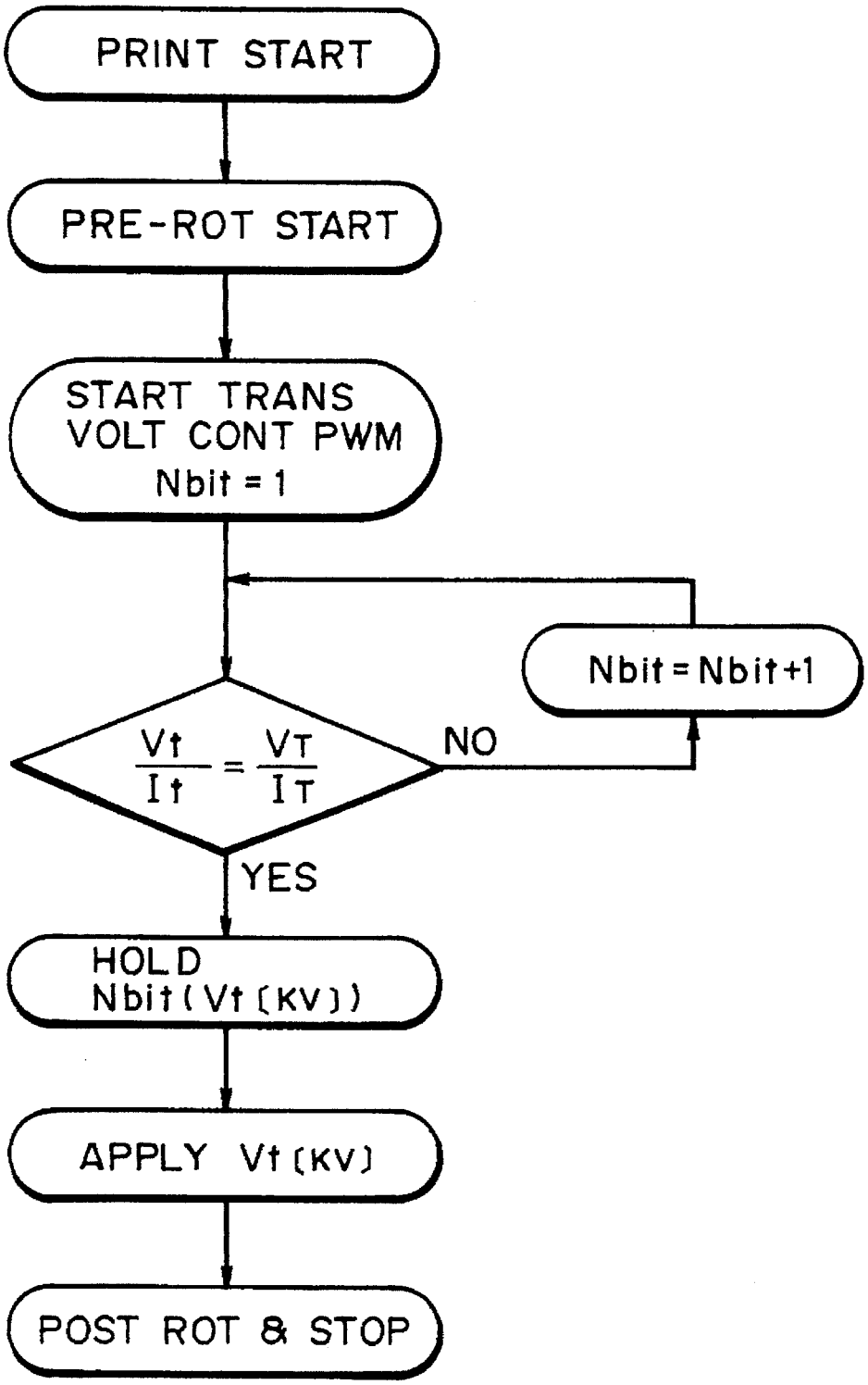
FIG. 16 is a flow chart of sequential operations of a transfer bias control according to a fourth embodiment of the present invention.

FIG. 16 is a flow chart of sequential operations of the apparatus of this embodiment (bias control).

Figure 17:
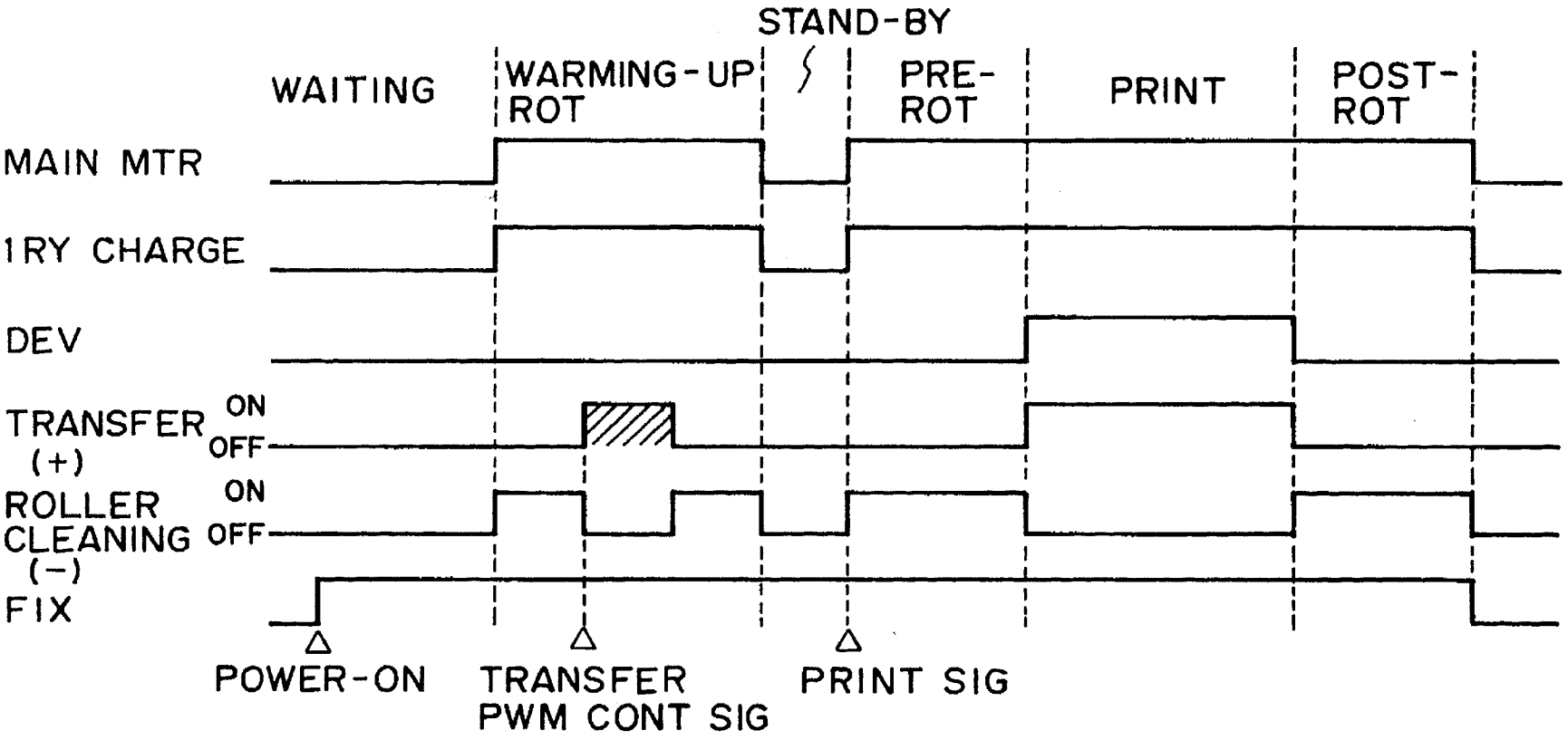
FIG. 17 is a timing chart when the transfer bias is controlled during a warming-up rotations.
Figure 18:
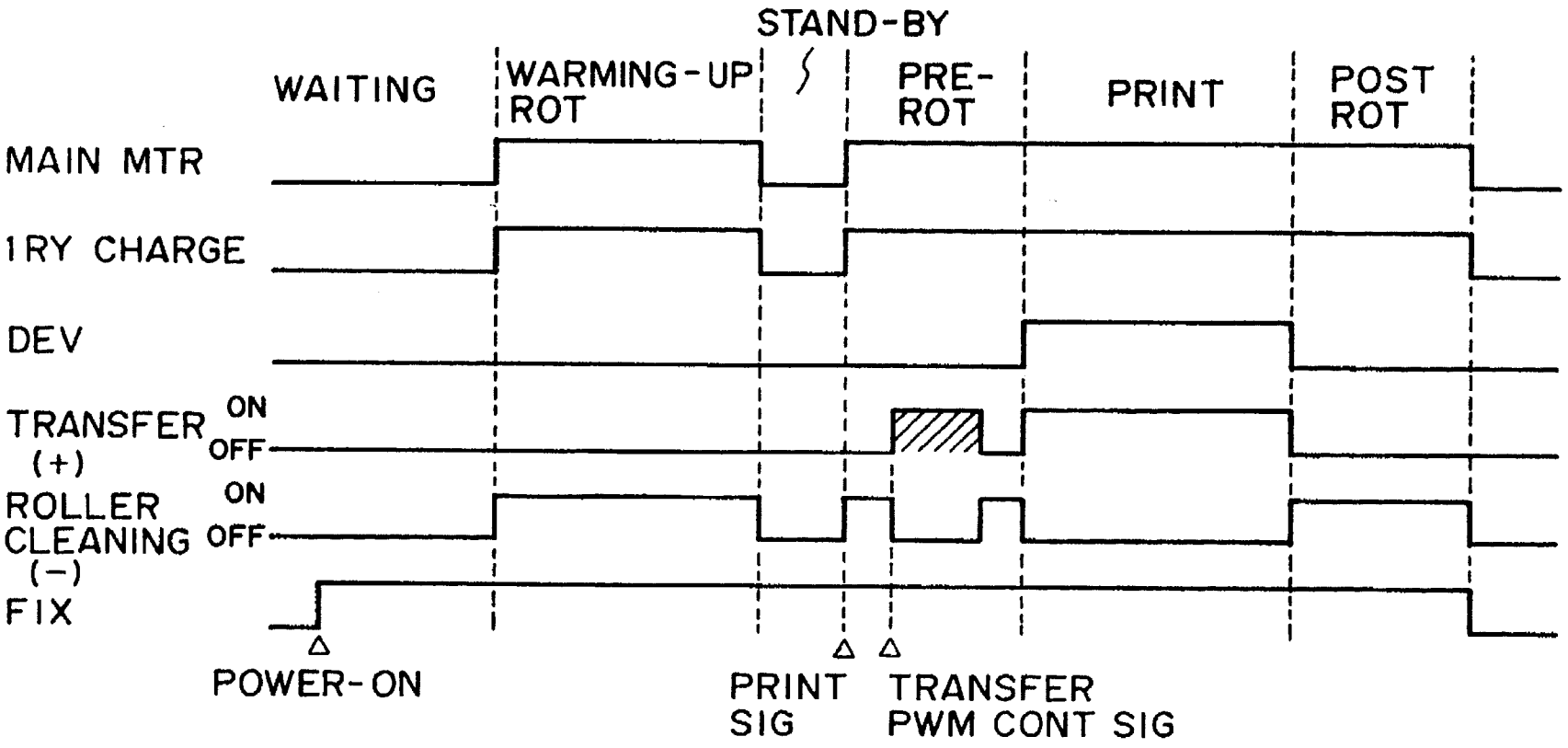
FIG. 18 is a timing chart when the transfer bias is controlled during a pre-rotation period.

FIGS. 17 and 18 are timing charts when the apparatus of this embodiment is operated. When the operation is carried out, it is done before the start of the transfer operation. When the main switch of the laser beam printer is turned on, the fixing device is energized. Before or after the completion of the warm-up of the fixing device, the photosensitive drum is rotated (warming-up rotation). The warming-up rotation is carried out for a predetermined period of time at the time of the starting up of the laser beam printer for the purpose of cleaning the surface of the photosensitive member and making the surface potential thereof uniform. FIG. 17 is a timing chart in the case that the operation of this embodiment is carried out during the warming up rotation. FIG. 18 is a timing chart in the case that the operation of this embodiment is carried out during the pre-rotation period, the pre-rotation being carried out after the printing signal is produced and before the transfer material reaches the transfer position.

In FIGS. 17 and 18, the transfer bias PWM control is carried out during the warming-up rotation period and the pre-rotation period. Outside the printing operation, the transfer roller is supplied with a bias voltage having the same polarity as the toner is applied so that the transfer roller is cleaned.

The operation of this embodiment may be carried out during the warming-up rotation period or during the pre-rotation period. If it is incorporated in the warming-up rotation period, the pre-rotation period is not required to be made longer for the purpose of control, so that the reduction of the throughput can be avoided. If it is carried out during the pre-rotation period, the new transfer bias is selected for each of the printing operations, and therefore, the correct transfer bias control is accomplished.

In this embodiment, the better transfer bias control is intended, and therefore, the timing chart of FIG. 18 is used.

Each of the transfer rollers A–D of FIG. 11 is incorporated in the laser beam printer of FIG. 1, and the images are produced with the control described. Then, 1.2 KV, 2.2 KV, 2.95 KV and 4.25 KV are obtained for the transfer rollers A–D, respectively. The electric current during the passage of the transfer material through the transfer station was 1.2–1.8 μA, so that good images were formed on the transfer material with high transfer efficiency.

Even if the resistance of the transfer roller changes with time elapse or the ambient condition change, the tendency of the V-I curve does not change. Therefore, the electric current through the transfer material can be controlled irrespective of the value of the resistance of the transfer roller, and therefore, a highly accurate transfer bias control is accomplished.

Figure 19:
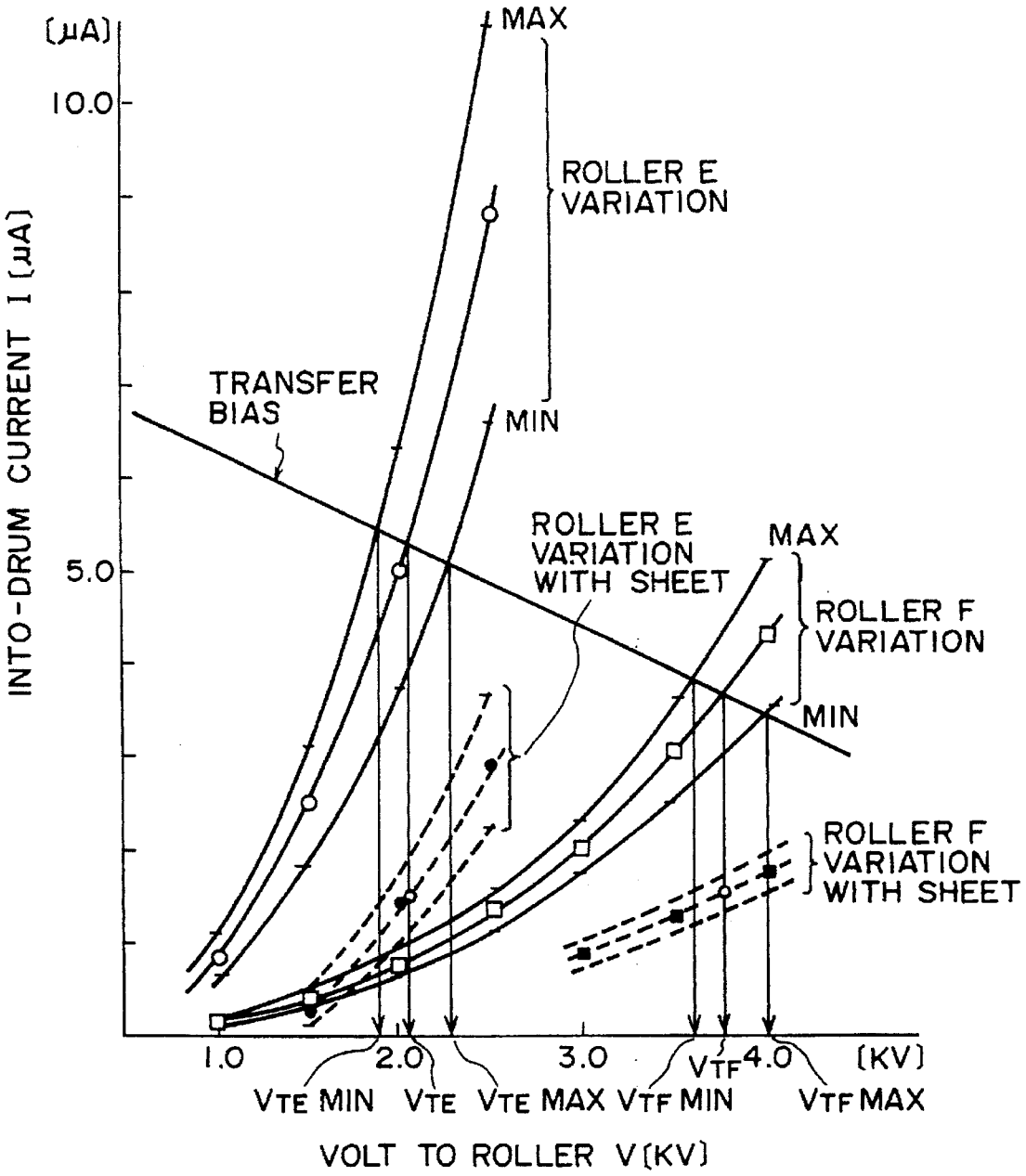
FIG. 19 is a graph of V-I curves when the resistance of the transfer roller is uneven.

Referring to FIG. 19, the description will be made as to a fifth embodiment of the present invention. In the transfer roller or the like (transfer member), the foaming rubber material and the filler material dispersed therein are not mixed to sufficiently uniform extent due to the manufacturing problems. As a result, the transfer roller resistance is not even in the longitudinal and circumferential directions thereof.

FIG. 19 is a graph of V-I curves when when a transfer roller is used. Because of the existence of the variation of the resistance of the transfer roller, the electric current flowing into the photosensitive drum varies even if a constant voltage is applied to the transfer roller, as shown in FIG. 19. In the case of the transfer roller E, the center value of the electric currents varies approx. ±20%, and in the case of the transfer roller F, it varies within ±10–20%.

If the transfer rollers are incorporated in the laser beam printer of FIG. 1, and the transfer bias control of Embodiment 4 is carried out, the required transfer voltage $V_{TE}$ is not determined for the transfer roller E, but the voltage oscillates within the following range:

$$V_{TEmin} \leqq V_{TE} \leqq V_{TEmax}$$

In the case of the transfer roller F, the voltage $V_{TF}$ oscillates within the following range;

$$V_{TFmin} \leqq V_{TF} \leqq V_{TFmax}$$

When the transfer voltage oscillates in this manner, particularly when the printing is carried out using a transfer roller having a relatively low resistance as in the transfer roller E, the current flowing through the transfer material during the printing operation also oscillates, as shown in FIG. 19.

More particularly, if it is assumed that the desired transfer voltage $V_{TE}$ is 2.05 KV in the transfer roller E, the voltage deviated by the unevenness of the resistance of the transfer roller in the circumferential direction is ±200 V, and therefore:

at the maximum voltage, $V_{TEmax}$=2.28 KV at the minimum voltage, $V_{TEmin}$=1.88 KV As compared with the electric current of 1.0–1.8 μA through the transfer material with the optimum transfer voltage $V_{TE}$, the electric currents are:

0.8–1.4 μA, at the time of $V_{TEmin}$ 1.6–2.6 μA, at the time of $V_{TEmax}$

Looking at the minimum and maximum levels at this current, the variation occurs within the range of 0.8–2.6 μA. The minimum current 0.8 μA is not sufficient with the result of improper image transfer, whereas 2.6 μA is too large with the result of toner scattering, blurrness and low image transfer efficiency.

In order to solve these problems, it is desirable that the converging point is as close as possible to the voltage $V_{TE}$.

In this embodiment, the convergence is accomplished in the following manner. Before the start of the transfer operation, the voltage applied to the transfer roller is gradually increased, and the V-I characteristics of the transfer roller relative to the photosensitive member is made closer to a point on a predetermined transfer bias setting line, and the operation is repeated plural times. Then, the held voltages are averaged to obtain a desired bias voltage.

Figure 20:
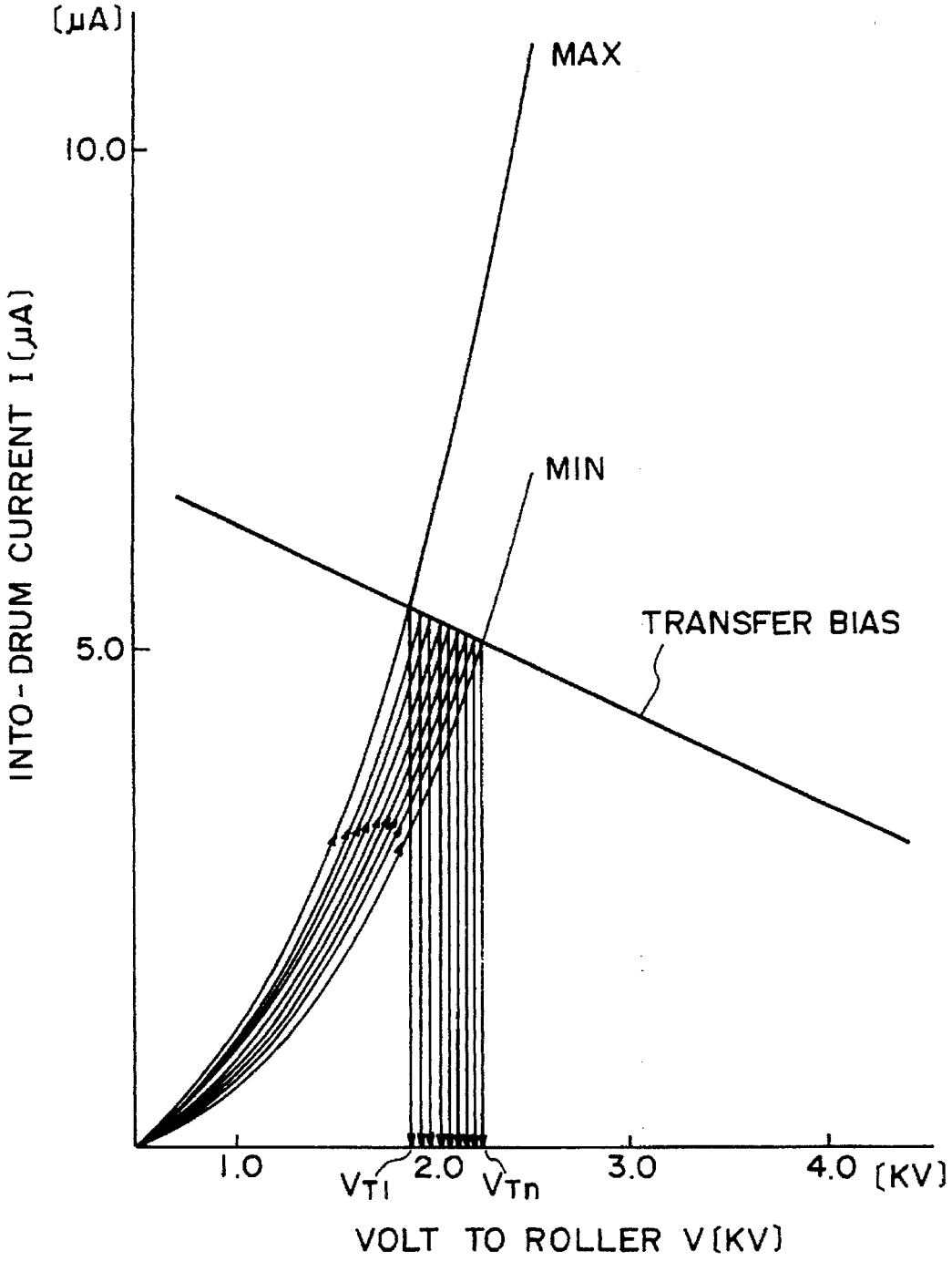
FIG. 20 is a graph explaining plural converging operation in a fifth embodiment of the present invention.

Referring to FIG. 20, this transfer bias control system will be described. The control is carried out during the pre-rotation period before the start of the transfer operation. However, the control operation may be carried out a certain predetermined number of times or a number of times capable within a predetermined time period. In this embodiment, the control period is 1.26 sec corresponding to the one full turn of the transfer roller, and the control operation described in Embodiment 4 is carried out. Using such control means, the time required for increasing one time the voltage from 0 to $V_T$ (KV) is approx. 50–100 msec. Therefore, at least 10 sampling operations are possible. The voltages $V_{T1}$–$V_{Tn}$ obtained by the control are averaged, and the average voltage is used as a transfer voltage $V_T$ (KV).

Figure 21:
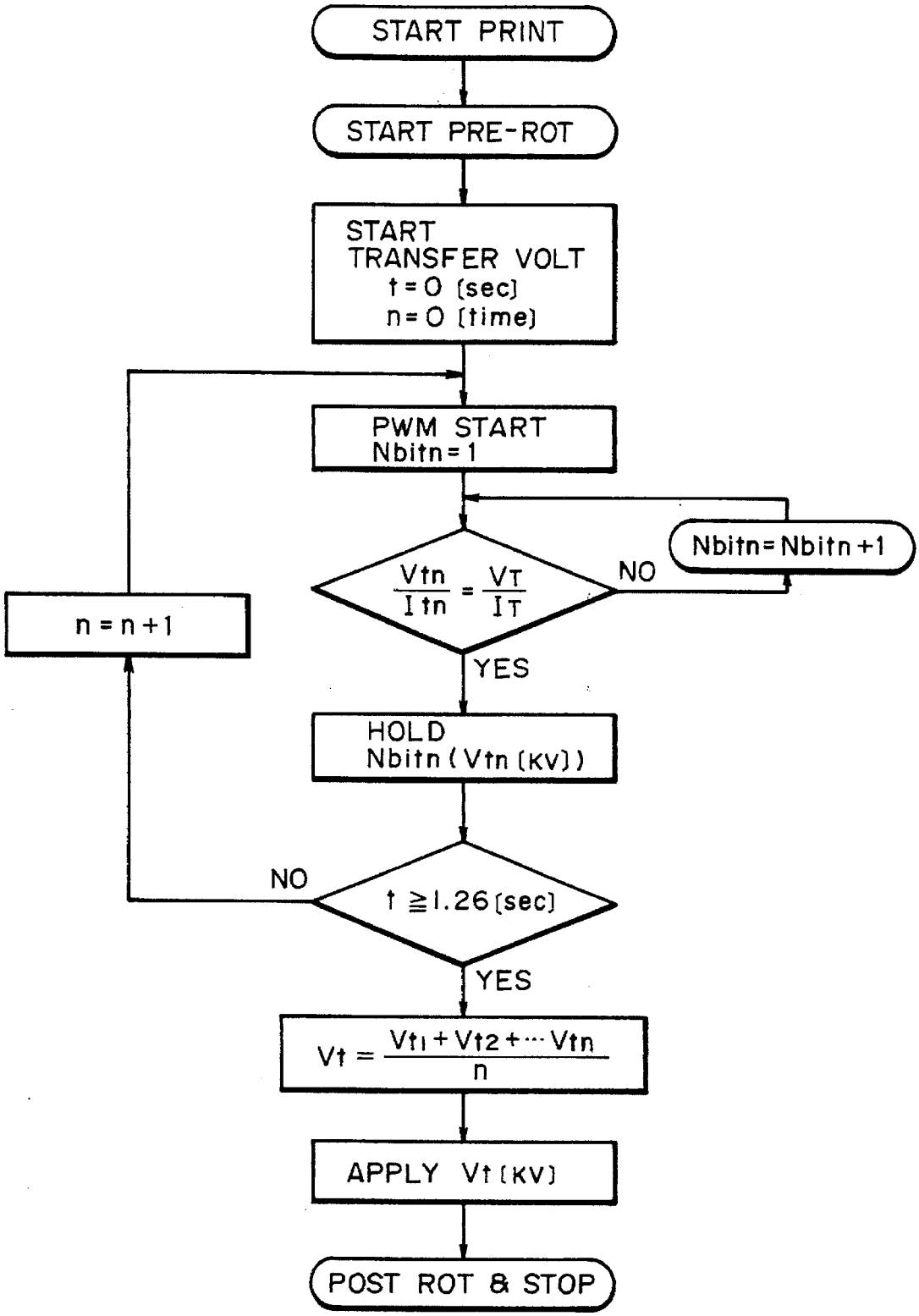
FIG. 21 is a flow chart of sequential operations of the transfer bias control in the fifth embodiment.

FIG. 21 is a flow chart of sequential operations described above.

The transfer rollers E and F of FIG. 19 are incorporated in the laser beam printer of FIG. 1, and the transfer bias is controlled in the manner described above, and the printing operation is carried out. The desired transfer bias voltage $V_{TE}$=2.08 KV. In the case of transfer roller E, it was 2.2 KV, and in the case of the transfer roller F, it was 3.75 KV.

By the use of the control of this embodiment, the deviation of the target of the transfer bias control which has been ±5–10% was reduced to within ±3–5%. The prints using the transfer roller were free from toner scattering, blurrness improper transfer or the like, therefore, the accomplishment of high accurate control was confirmed.

As will be understood, according to Embodiment 6, the V-I characteristics of the transfer roller relative to the photosensitive member is more accurately converged to one point on a transfer bias setting line. In the foregoing embodiment 5, whenever the determination of the V-I characteristics of the transfer roller, the voltage is increased from Vt=0 (V). However, it would be considered has being waste of time that the voltage is once increased to Vtn by the PWM control and is lowered to 0 V, and is increased again to $V_{tn+1}$.

Figure 22:
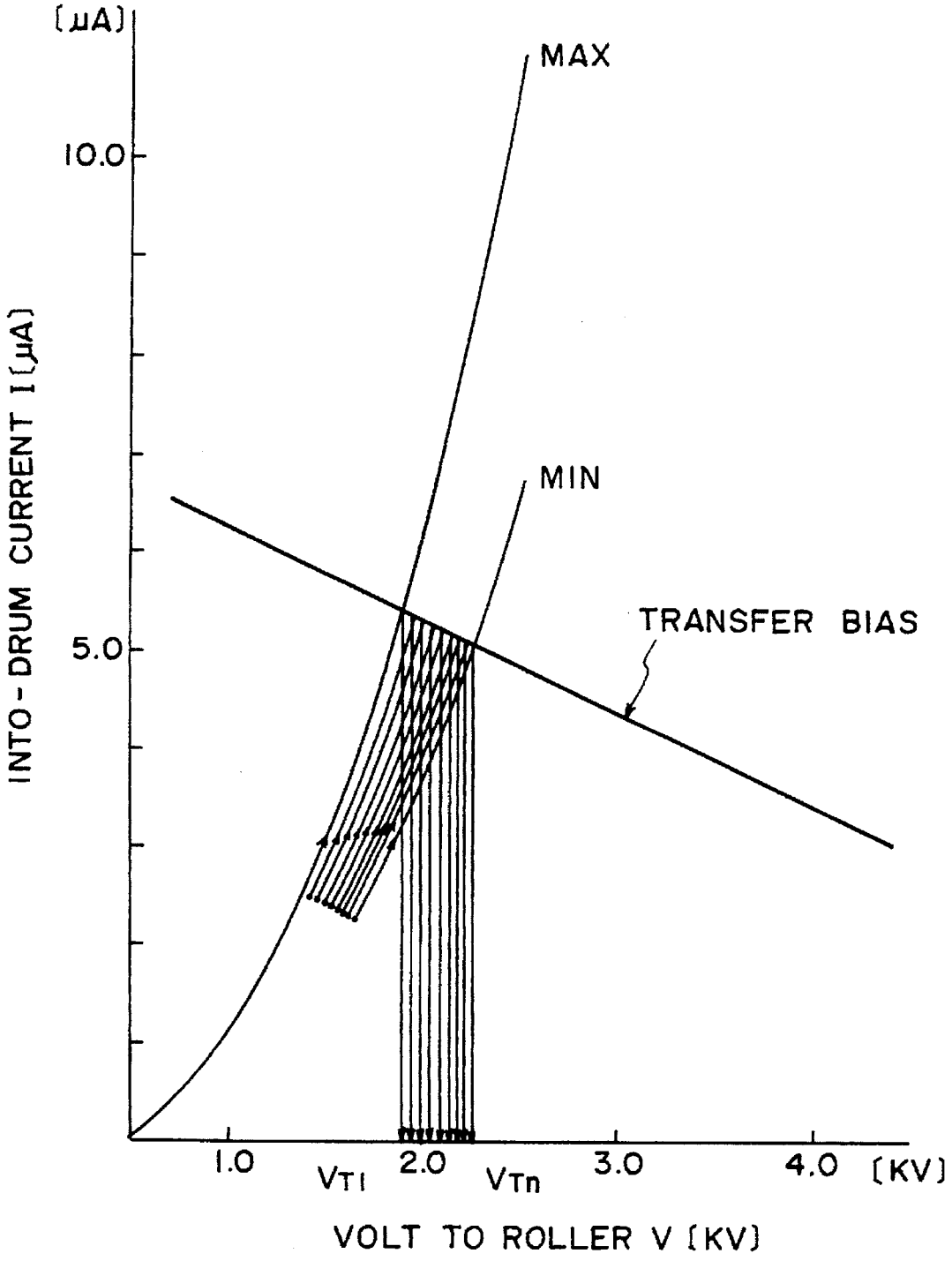
FIG. 22 is a graph for explaining operation where the sampling period is reduced, in an apparatus according to a sixth embodiment of the present invention.

In this embodiment, the time required for the PWM control is saved, and the number of converging operations is increased so that the highly accurate control is accomplished. FIG. 22 shows a model incorporating this control. When a first intersection $V_{t1}$ is determined between the V-I characteristic curve and the transfer bias setting line, a voltage which is $(3/4)\times V_{t1}$ as well as the voltage $V_{t1}$ is held, and in the control of the next stage, the voltage is increased from the $(3/4)\times V_{t1}$ not from 0 V.

The coefficient of ¾ above is determined by the Inventors. If it is too small, the advantageous effects of the feature of this embodiment is less significant, and therefore, the effects are similar to that of Embodiment 5. If the coefficient is closed to 1, the following problem arises. When the voltage obtained as a result of first conversion is higher than the average, the current exceeds the level on the transfer bias setting line, and therefore, no conversion is reached thereafter.

In view of the above two requirements, a proper coefficient is desirably selected. Usually, a relatively low resistance transfer roller involves a higher likelihood of not converging to a one point on a transfer bias setting line, and therefore, it is desirably 0.5–0.8 times the converged voltage. In this embodiment, it is ¾=0.75.

Figure 23:
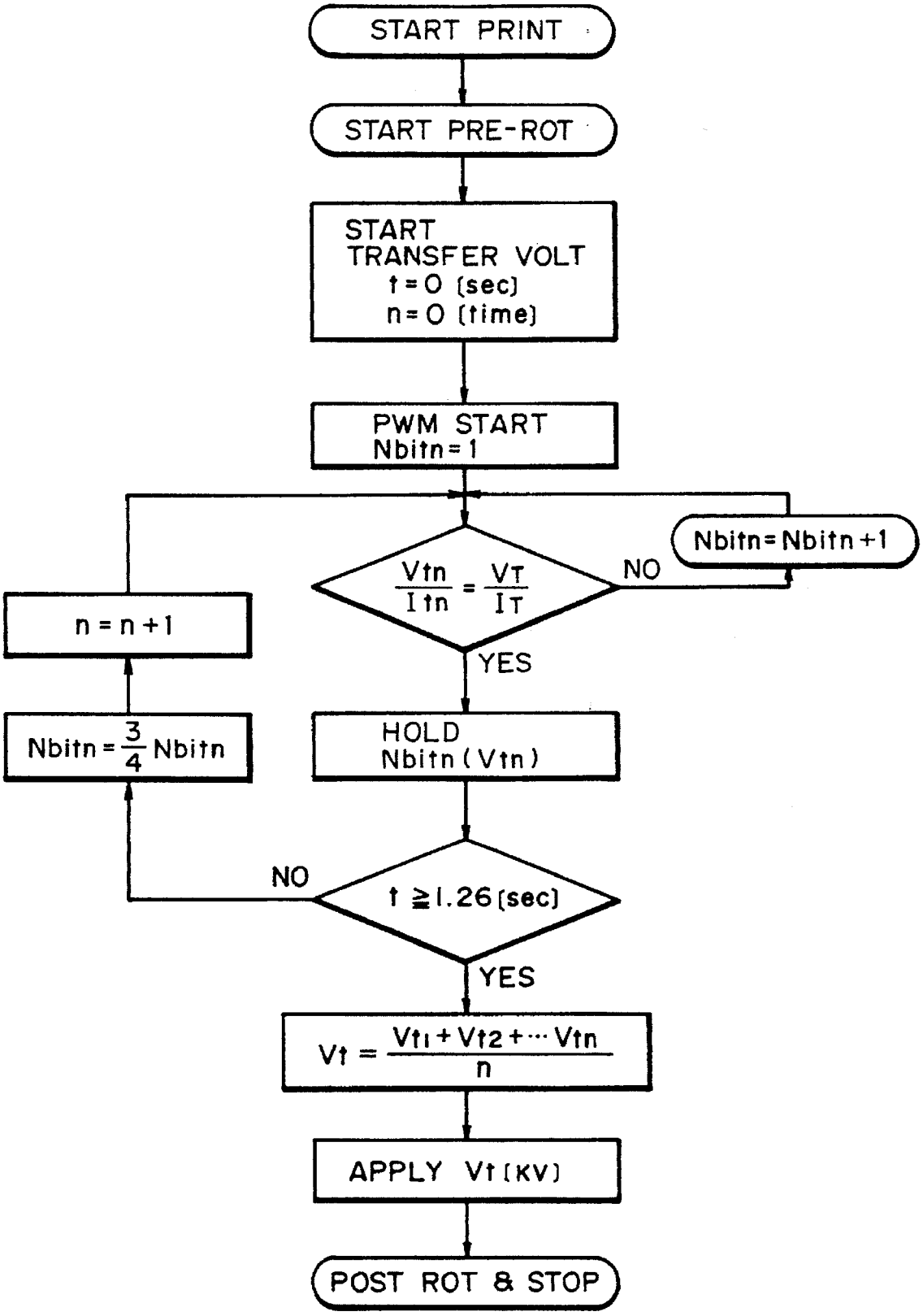
FIG. 23 is a flow chart of sequential operations of the transfer bias control in the sixth embodiment.

FIG. 23 is a flow chart of the sequential operations of the above-described transfer bias control operation. In the operation of this flow chart, the PWM control of the transfer bias continues for 1.26 sec corresponding to one full turn of the transfer roller 1. However, the sampling period is ¼, that is, until 0 V=reached, and therefore, the number of sampling operations is four times, by which the control accuracy is increased. The time required from 0 V–$V_{Tn}$ V which was 50–100 msec is reduced to 15–25 msec. The number of sampling operations is 30–40 times. As a result, the accuracy of the desired transfer bias voltage level is significantly increased. The experiments have been carried out with the transfer roller E used in Embodiment 5. It has been confirmed that the voltage converges to the desired level with the variation of ±1–2%, so that the higher accuracy of the transfer bias control is confirmed.

The description will be further made as to a PTVD control sequence of the transfer roller.

Referring back to FIG. 1, the photosensitive drum 1 is driven by an unshown driving device, and a primary charge bias is applied from a voltage source 3 to the charging roller 2 so as to uniformly charge the surface of the photosensitive member to a potential $V_D$. As soon as the portion of the photosensitive drum 1 charged by the charging roller 2 reaches the transfer position, the D/A converter **9*b* is supplied with a signal from the DC controller 10**, and the voltage starts to be increased stepwisely.

Figure 26:
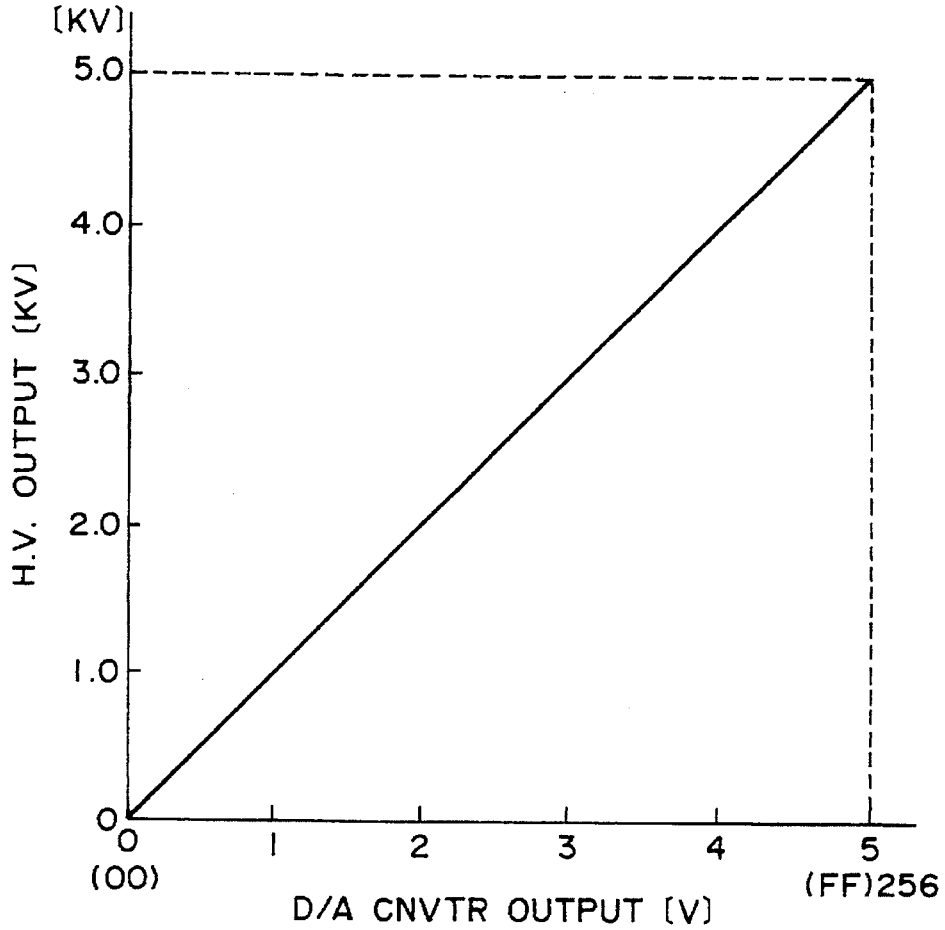
FIG. 26 is a graph of a D/A converter output vs. transfer high voltage output.

FIG. 26 shows a relation between an output voltage of the D/A converter **9*b* and the output voltage of the voltage source 3. When a digital signal 00–FF is supplied to the D/A converter 9*b* from the DC controller 10, it is converted to an analog voltage 0–5 V, and output voltage of 0–5 KV is produced from the voltage source 3. The voltage source 3 functions to apply a constant voltage between the photosensitive drum 1 and the transfer roller 6**.

Figure 27:
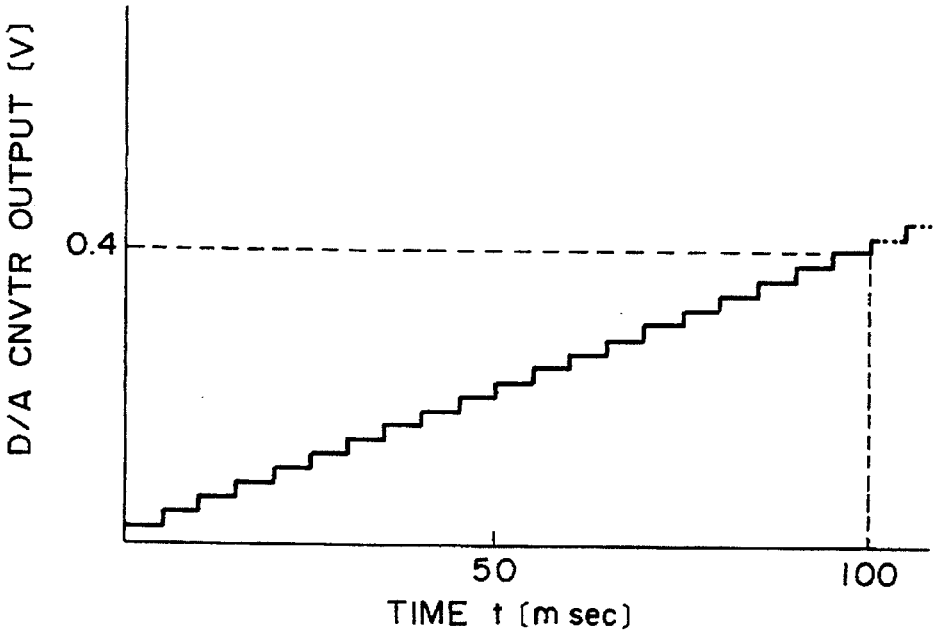
FIG. 27 is a graph of a D/A converter output for controlling the voltage applied to the transfer roller.

FIG. 27 shows the operation of increasing the voltage described above. The abscissa represents time t (msec), and the ordinate represent the output voltage (V) of the D/A converter.

In FIG. 27, the transfer roller is supplied for 5 msec with 1 lsb: maximum transfer output voltage (V)/256 (bits)= 5000/256≃20 V, and the voltage is gradually stepped up. The time period of 5 msec is selected for the following reasons. The foamed EPDM roller used in this embodiment has a certain level of electrostatic capacity, and therefore, with the application of short period pulse voltage, the voltage is applied to the surface of the photosensitive drum 1 in the form of a differential thereof. As a result, an excessive current flows with the result of abnormal operation. In addition, a high voltage output circuit involves a rising response delay, and therefore, the voltage is to be continued to be applied for a predetermined period of time. If, however, the time period is too long, a longer time is required for the stepping up. The time period substantially satisfying the two conditions is 2–10 msec, and therefore, 5 msec is selected in this embodiment.

Figure 28:
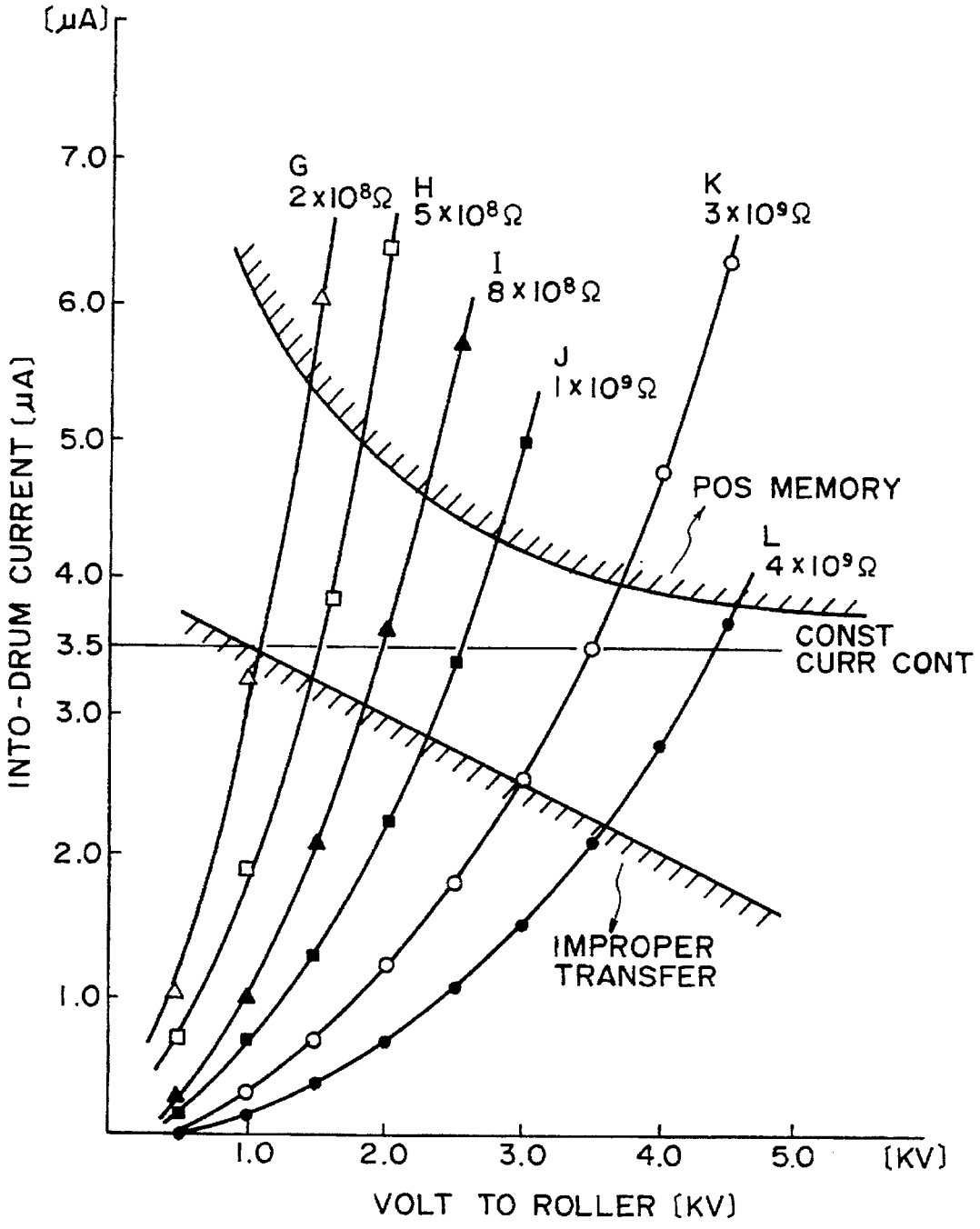
FIG. 28 is a graph of current-voltage curves of the transfer roller.

FIG. 28 is a graph showing a relation between a voltage applied to the transfer roller and the electric current flowing into the dark potential portion $V_D$ of the photosensitive member with a parameter of the resistance of the transfer roller 6. The transfer rollers G–L have different resistances of $2\times10^8$–$4\times10^9$ Ω due to the manufacturing errors. The resistances of the transfer rollers are measured in the method described hereinbefore. FIG. 28 shows the voltage-current characteristics for the transfer rollers G–L respectively, relative to the potential (−600 V) of the photosensitive drum. The used transfer material on which the images are printed, had been left under the low temperature and low humidity condition (15° C., 10% RH) which is the difficult condition for the image transfer operation. The voltage-current characteristics of the transfer roller are represented as curves because the resistance of the material of the transfer roller is dependent on the voltage. Even if the same transfer roller is used, the above-described positive memory influences the printed image if the applied voltage is high. More particularly, since a strong opposite polarity (positive) electric charge is deposited on the surface of the photosensitive member, the voltage is not restored to the dark portion potential $V_T$ level even after the subsequent primary charging step, with the result of local low voltage portion having a voltage level lower than the developable level, which portion receives the toner and appears as a foggy background in the next image.

In the graph of FIG. 28, a negative memory line is indicated at the upper portion of the graph, which is plots of boundary voltages resulting in the positive memory. On the other hand, when the voltage applied to the transfer roller is low, it is unable to apply the electric charge which is sufficient to strongly retain the toner on the transfer material, and therefore, when the transfer material is separated from the photosensitive member, the toner particles are scattered from the image portion to the non-image portion (background) with the result of improper image transfer. The improper transfer region is shown in the lower part of the graph.

In order to provide the good print images under the above-described ambient condition, the transfer bias control is desirably effected in the region outside the above two regions.

In the middle of FIG. 28, there is shown a constant current control line which is supplied to the transfer roller for the selection of the transfer bias. In this embodiment, it is 3.5

μA. The description will be made as to how the substantially constant current control (3.5 μA) is carried out using the PTVC system.

As shown in FIG. 28, the voltage applied to the voltage source 3 is stepwisely increased so as to converge the electric current to 3.5 μA. However, the problem here is that the time required for the conversion is different depending on the resistance of the transfer roller, and that with the transfer roller having a high resistance, the conversion requires quite a long time.

As a means for solving this problem, it would be considered to increase the voltage corresponding to 1 lsb. In the above-described example, 1 lsb corresponds only to 20 V. If the voltage corresponding to 1 lsb is increased to 100 V or 200 V, for example, the conversion to the desired level is accomplished very quickly. However, if the voltage corresponding to 1 lsb is increased that much, the overshoot of the detected current is increased in the case of relatively low resistance roller although the converging period for the high resistance transfer roller is shortened. Thus, in the case of the relatively low resistance roller, the converging period is longer. Therefore, the voltage corresponding to 1 lsb is desirably so determined that the overshooting is small enough within the used resistance range of the transfer roller and that the converging period is short enough.

As a result of Inventors' experiments and investigations, 60 V/1 lsb for 5 msec results in the minimum converging period.

Among the transfer rollers shown in FIG. 28, the time required for conversion to 3.5 μA was approx. 300 msec in the case of the transfer roller G having the lowest resistance of $2\times10^8$ Ω; it was approx. 1000 msec in the case of the transfer roller L having the highest resistance of $4\times10^9$ Ω.

On the other hand, when the transfer roller is manufactured, the dispersion of the electrically conductive filler of the transfer roller is not uniform in the circumferential direction, and therefore, the resistance of individual transfer roller is uneven in the circumferential direction. Therefore, according to this embodiment, the substantially constant current control is effected to the transfer roller before the start of the transfer operation. At this time, the produced voltage corresponding to the resistance of the transfer roller at the transfer position is sampled at least during one full turn of the transfer roller, and the sampled voltages are averaged.

Accordingly, the constant current control to the transfer member or roller through the PTVC method requires the time period of (the period for converging the constant current level)+(the sampling period for one full turn of the transfer roller).

In the above-described ATVC system, the constant current control means is in the form of a hardware circuit, and therefore, the voltage converges to a sufficient extent, and the sufficient sampling operations are possible, within the time period of the preparatory rotation period for the purpose of cleaning and potential adjustment of the surface of the photosensitive member during the printing operation.

If the PTVC process is carried out during such a pre-rotation period, the transfer bias setting requires a long period so that the first print time becomes very long.

In order to sufficiently use the advantageous effects of the PTVC system, it is desirable that a first PTVC control (rough control mode) is carried out during a warming-up rotation period and that a second PTVC control (fine control mode) is carried out during the pre-rotation period. The warming-up rotation period is the period, as described hereinbefore, which is carried out immediately after the main switch is actuated and before the printing operation is started for the purpose of warming-up the laser beam printer, cleaning the surface of the photosensitive member, making the surface potential thereof uniform, heating the fixing and pressing roller or the like. More particularly, the first PTVC control (PTVC 1) is carried out during the warming-up rotation period until the conversion is reached to a predetermined current level, and the second PTVC control (PTVC 2) is carried out for one full turn of the transfer roller to correct the circumferential unevenness of the resistance of the transfer roller, during the pre-rotation period, for the time period required for the sufficient sampling with the converged constant current level.

Here, the warming-up rotation period will be described. After the actuation of the main switch, the fixing device is first energized. Before the completion of the fixing device warming-up, the warming-up rotation is started and is completed substantially simultaneously with the completion of the warming-up of the fixing device. This is because the damage of the surface of the fixing roller by the toner fixed on the thermo-switch, thermister, separation pawls or the like, is to be avoided.

Figure 24:
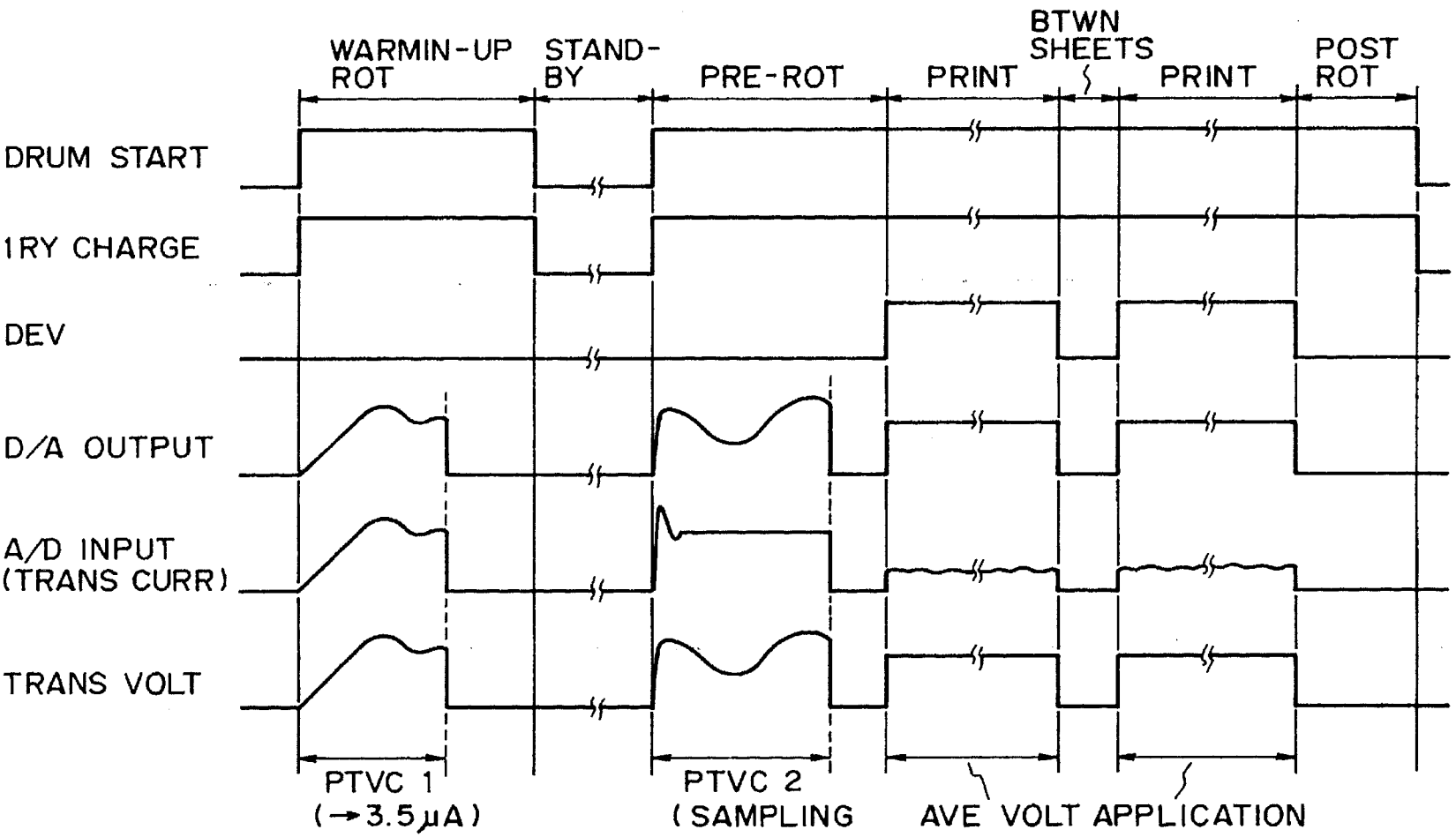
FIG. 24 is a time chart of an example of a transfer output control.
Figure 25:
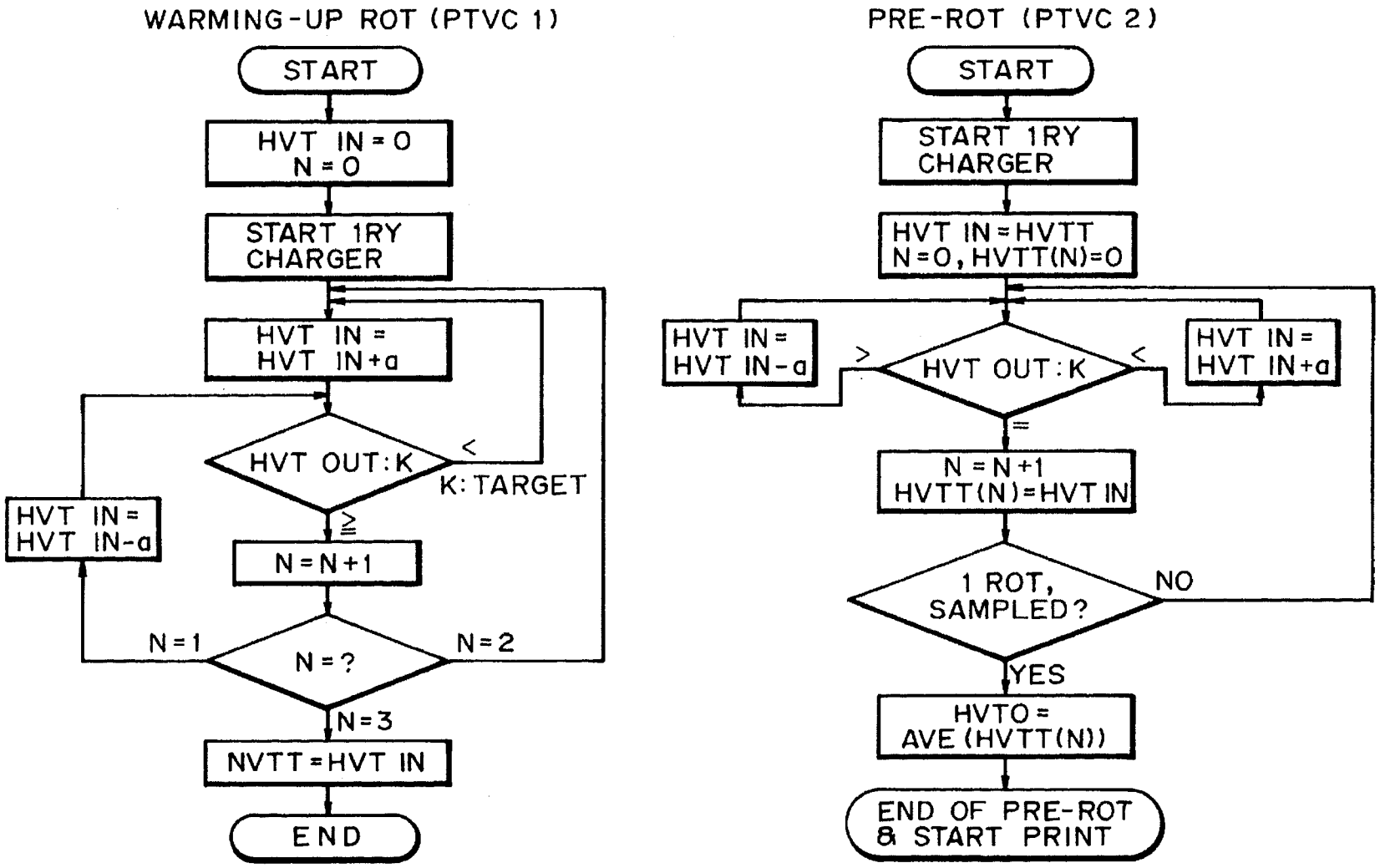
FIG. 25 is a flow chart of sequential operations in an example of the transfer output control in accordance with the present invention.

FIG. 24 is a time chart of the transfer bias control, and FIG. 25 is a flow chart of the sequential operations controlled by the CPU contained in the DC controller 10. The first PTVC control PTVC1 is carried out after the start of the warming-up rotation and when that portion of the photosensitive member which has been subjected to the charging operation of the primary charger reaches the image transfer position. A signal HVTIN is supplied from the CPU to a D/A converter 9*a*, and a voltage of 60 V/lsb is supplied to the transfer roller from the voltage source 3 for 5 msec. In FIG. 25, a is a voltage incremented at 1 step (lsb). In this embodiment 1 lsb corresponds to 20 V, and the increase by 1 step is 60 V, and therefore, a is 3.

In accordance with outputs, from the voltage source 3, of sequentially increased constant voltages by way of the D/A converter 9*b*, the electric currents flowing into the photosensitive drum from the transfer roller, are supplied to the A/D converter 9*a* through a current detecting circuit 14, and are converted to 0–5 V voltages, and thereafter, they are supplied to the CPU in the DC controller in the form of a digital signal HVTOUT. Then they are compared with a target value K. The target value K corresponds to the predetermined 3.5 μA which is converted by the A/D converter 9*a* in the current and voltage. It is a possible alternative that the converted level is selected in the software.

Since the output speed of the D/A converter is higher than that of the A/D converter, and therefore, after the detected current conversion by the A/D converter becomes the same as the target level K (detected current is 3.5 μA) in the sequential operations of the first PTVC operation, the output voltage of the voltage source 3 by the D/A converter is further stepped up, and therefore, the transfer output voltage is in the overshoot state. The value HVTIN is increased and decreased, and when the conversion of the detected current becomes the target value K three times, the first PTVC operation PTVC1 is terminated. Simultaneously, a digital signal HVTIN representing the transfer voltage capable of flowing 3.5 μA is stored in the CPU as HVTT, and the pre-rotation is terminated.

Then, a series of printing operation for forming an image on a transfer material is started. That is, the pre-rotation is started. Then, the second PTVC operation PTVC2 starts. In the second PTVC operation PTVC2, the signal VHTT stored as a result of the first PTVC operation PTVC1, is produced from the CPU. At this time, the transfer output voltage is quickly increased. The A/D conversion HVTOUT from the current detected by the current detecting circuit 14 with this transfer output voltage is very close to the target value K, and therefore, as in the first PTVC operation PTVC1, it is quickly converged to the target K by increase and decrease of the signal HVTIN. By fine control of HVTIN, the converged state is maintained. Thereafter, the operation is repeated at least during one full turn of the transfer roller, and the level of the HVTIN signal corresponding to the K level is sampled. When the one full turn is completed, the sampled values are averaged by the CPU. Then, the transfer bias signal VCTO is stored. During the passage of the transfer material through the transfer station, the voltage is applied to the transfer roller from the voltage source 3.

The transfer output voltage thus obtained has been optimized as shown in FIG. 28, and therefore, the image quality is not deteriorated in the transfer rollers shown in FIG. 28, that is, the images are good without positive memory or improper image transfer. During the second PTVC operation PTVC2 in the printing operation, the transfer bias signal is maintained in the second PTVC operation PTVC2, and the initial level HVTIN is HVTO, by which the conversion is quick, and the uniform images can be provided in the case of intermittent printing operations. In the case of the PTVC operation, unlike the ATVC operation, the constant current level can be set, and the transfer voltage during the transfer operation can be corrected only by the change of the software, and therefore, the portion of the system relying on the hardware is significantly reduced, and therefore, the control accuracy is increased, and the cost is reduced.

The problem of long control period can be solved by dividing the operation into the first PTVC operation during the warming-up rotation period before the printing operation and the second PTVC operation during the pre-rotation period in the printing operation. By doing so, the advantageous effect of PTVC operation can be used.

The second PTVC operation PTVC2 is not necessary if the resistance of the transfer roller does not vary in the circumferential direction due to the manufacturing error or tolerances. However, the first PTVC operation PTVC1 is required during the warming-up period before the printing operation, in order to reduce the time required before the start of printing operation is reduced.

A further embodiment of the transfer control will be described. This embodiment is particularly effective when the printing operation is not started immediately after the actuation of the main switch. The laser beam printers or the like used as peripheral equipments of computers or the like, are sometimes or frequently kept maintained on, that is, after the main switch is actuated, it is kept energized without deactuating the main switch until the next day.

If the laser beam printer is used in this way, and if the first PTVC operation PTVC1 is carried out during the warming-up period before the printing operation as in the foregoing embodiment, and the second PTVC operation PTVC2 is carried out during the pre-rotation in the printing operation, the change in the ambient condition caused by, for example, air conditioners in summer and heaters in winter results in the change of the resistance of the transfer roller due to the temperature and humidity change thereby. If this occurs, the second PTVC control PTVC2 will be significantly beyond the proper range.

In order to avoid this problem, in this embodiment, the first PTVC operation PTVC1 is repeated if the printing operation including the second PTVC operation PTVC2 is not carried out within a predetermined period of time after the completion of the previous first PTVC operation PTVC1. The apparatus used in this embodiment is similar to that of the embodiment described above, and therefore, the detailed description thereof is omitted for simplicity. The only difference is that the CPU in the DC controller 10 has the function of a timer.

Figure 29:
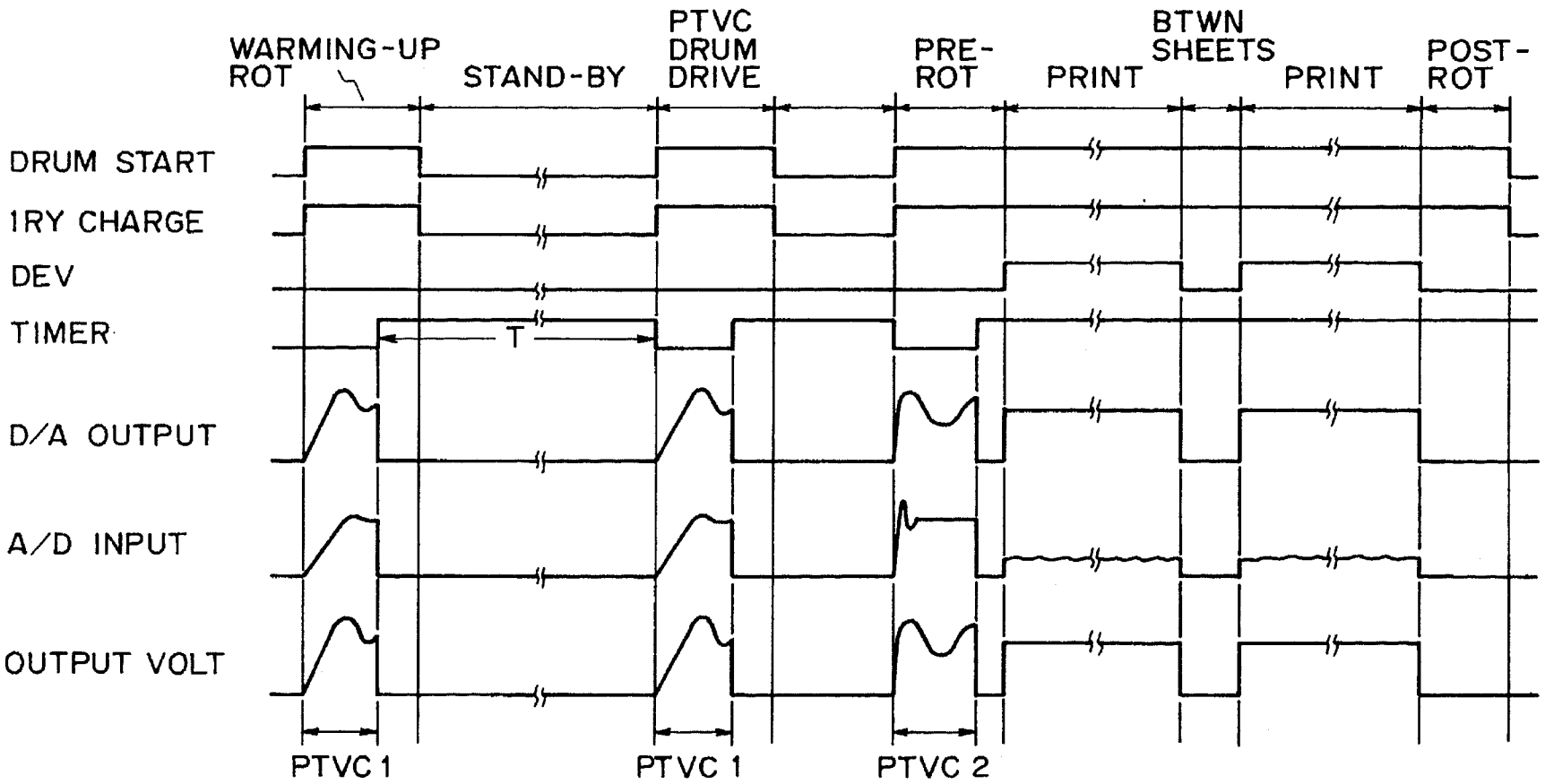
FIG. 29 is a time chart of another example of the transfer output control.

FIG. 29 is a time chart of the sequential operations of the transfer bias control of this embodiment.

In this embodiment, the process of the first PTVC operation during the warming-up rotation is the same as in the foregoing embodiment. However, upon the completion of the first PTVC operation, the timer in the CPU starts. When the printing operation, that is, the second PTVC operation PTVC2 does not starts even after a predetermined period of time T elapses, the photosensitive drum is automatically operated for the PTVC operation, and the first PTVC operation PTVC1 is carried out.

The time period T can be properly determined by one skilled in the art. It may be short period, but if it is too short, the wasteful photosensitive drum rotation will be frequently carried out. Since during this period, a voltage having a polarity opposite from the primary charge is directly applied to the photosensitive drum from the transfer roller without the transfer material therebetween, and therefore, the photosensitive drum may be deteriorated more quickly. For this reason, the PTVC operation is preferably carried out with proper time intervals. In consideration of the situation in which the office ambient conditions change from the morning to the evening, it has been found that one operation every 2–4 hours is enough. Therefore, the time period T is selected to be 2 hours in this embodiment.

The timer function reset by the start of the PTVC operation irrespective of the first or second PTVC operation, and is started simultaneously with the completion thereof.

In FIG. 29, the printing operation is started after the first mode PTVC operation PTVC1. At this time, similarly to the previous embodiment, the second mode PTVC operation PTVC 2 is carried out. The value HVTO obtained as a result of the second mode PTVC operation PTVC2 is stored in the CPU. In the print operation that is the second mode PTVC operation before the elapse of time period T, the HVTIN is set to be HVTO through the process shown in FIG. 25, so as to prevent the large deviation in the control.

Even if there is a time difference between the first mode PTVC operation PTVC1 and the second mode PTVC operation PTVC2, the first mode PTVC operation PTVC1 is carried out again by the operation of the timer, and therefore, the significant change of the ambient condition does not result in the large deviation of the control, and therefore, the good transfer operation is maintained at all times.

Figure 30:
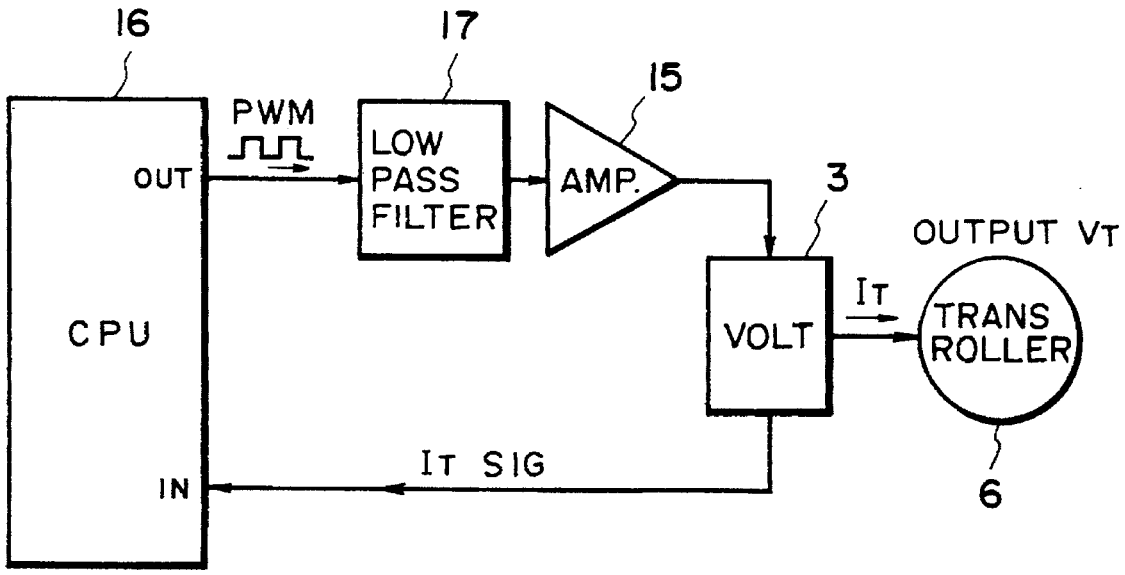
FIG. 30 is a block diagram of a transfer high voltage output circuit using the PWM signal and LPF in place of the D/A converter.
Figure 31:
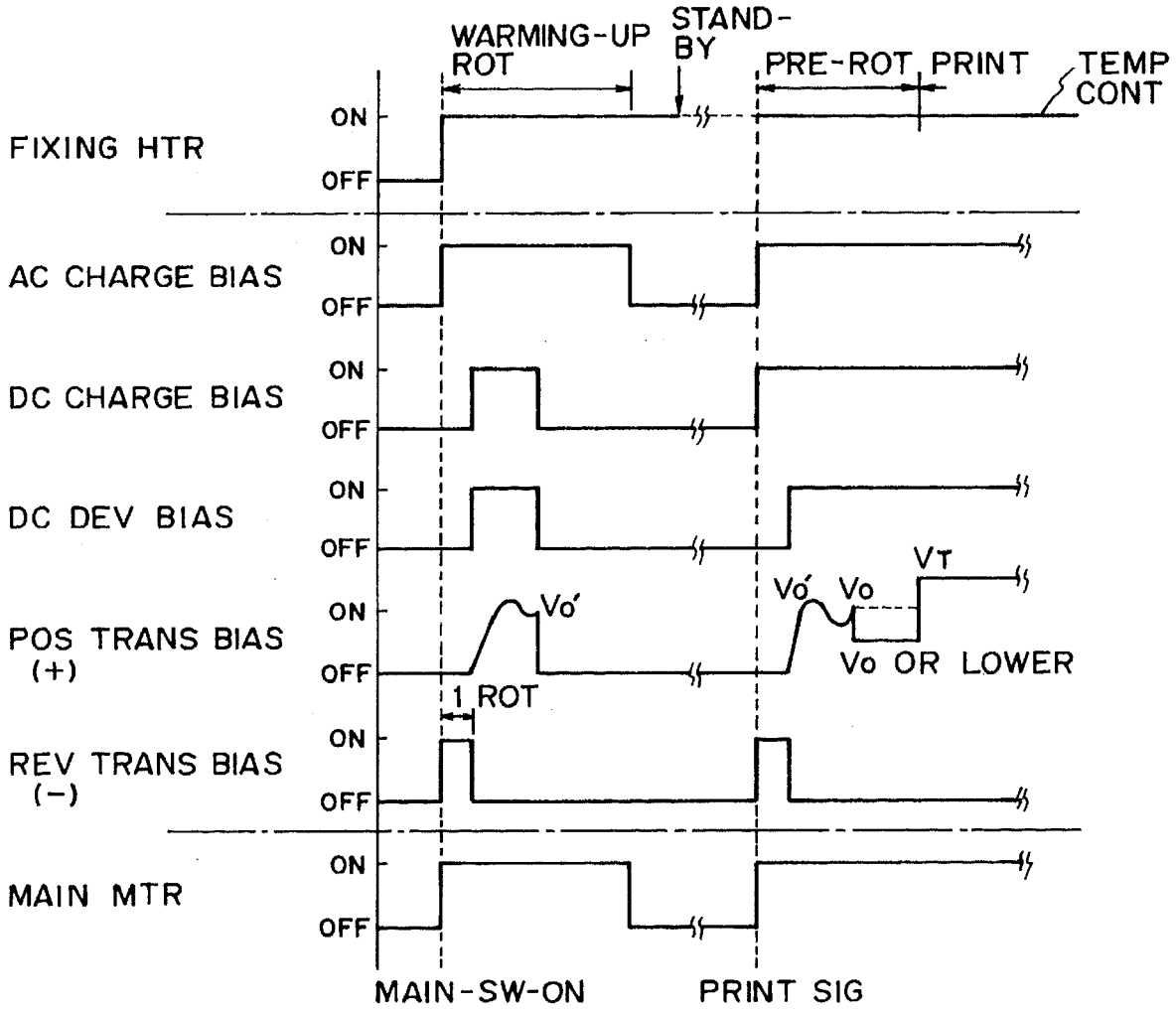
FIG. 31 is a time chart of a further example of a transfer output control.

FIGS. 30 and 31 are block diagram and time chart of the transfer control of an image forming apparatus according to a further embodiment of the present invention.

Referring to FIG. 30, a CPU 16 produces a PWM signal having a pulse width corresponding to a desired transfer output voltage, from an output terminal OUT. In this embodiment, a transfer output table (not shown) corresponding to various pulse widths is stored in the CPU 16. The PWM signal is converted to a digital signal by a low pass filter 17, and is amplified by an amplifier 15 into a transfer output voltage $V_T$. A signal corresponding to an electric current $I_T$ flowing at this time is supplied to an input terminal $I_N$ of the CPU 16, so that the CPU 16 detects it.

When the constant voltage control is to be effected, the PWM transfer output table present in the CPU 16 is looked up, and a PWM signal having a pulse width corresponding to a desired voltage is produced. When, on the other hand, the electric current flowing from the transfer roller 2 to the photosensitive drum 1 is to be constant-current-controlled, the pulse width of the PWM signal from the CPU 9 is gradually increased until the signal supplied to the input terminal $I_N$ of the CPU 16 reaches a level corresponding to the desired current level (constant current). Thereafter, the voltage (pulse width) is changed in accordance with the current level change to effect the constant current control.

As will be understood from the foregoing, the advantage of the PTVC control is in the elimination of the necessity of the constant current output circuit, and therefore, the cost can be reduced. In addition, by changing the setting in the CPU 16 (programmable in the CPU), the level of the constant current control may be freely changed. However, actually, when the PTVC system is used, the bias rising period during the constant current control is increased as compared with the case of the ATVC control system using the transfer high voltage and having the conventional constant current output circuit. Therefore, the first print time becomes longer when the PTVC control is carried out during the pre-rotation period after the input of the printing signal than when the ATVC operation is carried out. This problem can be solved in this embodiment because of the control sequences.

Referring to FIG. 31, when the main switch is actuated, a main motor, a fixing device heater, an AC bias voltage application to the charger and the transfer reverse bias application (−2 KV) are actuated. The transfer reverse bias application (negative polarity) is effective to transfer the negative polarity toner particles back to the photosensitive drum from the transfer roller, thus cleaning the transfer roller. After approx. 1 sec (after cleaning of one full circumferential periphery of the transfer roller), the first mode PTVC operation PTVC1 is started. In order to reduce the time period required for the rising to the constant level of the current, the bias voltage is increased in the similar manner as in the previous embodiment. Thereafter, the positive constant current control or the transfer material resistance detecting control operation is started. In this operation, the constant current control operation is carried out with a predetermined current at least for one full turn of the transfer roller in view of the uneven resistance of the transfer roller, and the voltage produced at this time is averaged, and the average is stored as V0'. During the constant current operation, the AC and DC voltages for the charging roller are applied, and a DC bias for the development is applied.

After the completion of the series of sequential operations, the potential of the transfer roller is grounded until the photosensitive member starts to rotate in response to the printing signal.

After the printing signal is supplied to the printer, the main motor is driven, and the AC voltage application to the charging roller and the application of the transfer bias voltage are actuated, similarly to the above case. After approx. 1 sec elapses, the second mode PTVC operation PTVC2 is started. At this time, a constant voltage control is first carried out using the voltage V0' stored, and thereafter, a constant current control operation is effected to determine the voltage V0 in the similar manner described above. Then, the voltage V0' is replaced by the voltage V0. Then, the constant current control is carried out, and the voltage V0 is stored until it is renewed. After the voltage V0' is stored, the control is effected with the voltage V0 (the voltage has a voltage level not leaving the memory in the drum), and when the transfer material reaches the transfer position, the proper transfer voltage $V_T$ calculated from the voltage V0 is applied.

Because of the above-described control, the pre-rotation period after the print instruction signal is not long, and therefore, the first print time is not long.

Because of the application of the reverse bias before the PTVC operation during the warming-up rotation, the accuracy of the transfer roller resistance (transfer current) detection during the PTVC control is significantly improved because of the assistance to the charging of the photosensitive member and the cleaning of the transfer roller. In addition, the cleaning effect of the transfer roller prevents the backside contamination of the transfer material during the image transfer operation on the transfer material.

Therefore, a high quality images can be produced.

In the previous embodiments, the transfer output control is effected using the software, and therefore, the unstable factors such as manufacturing tolerance and the temperature dependency can be removed out of consideration, and the highly accurate control can be realized with low cost. In addition, the software can be modified relative easily. The constants (constant current, voltage correcting coefficient or the like) in the transfer output control halving been determined in the process of the circuit design can be changed afterward.

Because the transfer output control is carried out at least two times, and the transfer output control is carried out during the warming-up rotation period and during the pre-rotation period, the problem of long control period which is a disadvantage of the constant current control using the digital voltage control, can be covered to a sufficient extent, and therefore, the advantageous effects of the digital voltage control can be completely used.

As described, according to the present invention, the transfer bias control can sufficiently meet the manufacturing variation of the resistance of the transfer member, the variation in the ambient condition, the variation with time of use, the variation in the voltage or the like. In addition, the improper image transfer under the L/L condition and H/H condition can be avoided. The bias control can be most appropriate to the individual transfer member, and therefore, the latitude or margin of the resistance of the transfer member is expanded. The yield of the transfer member manufacturing is increased, and therefore, the manufacturing cost thereof can be decreased. The good image transfer operations are possible within the wider resistance range than in the conventional apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

image forming means for forming an image on a recording material, said image forming means including an image bearing member, a charging member and a voltage source for supplying electric power to said charging member; and determining means for determining a substantial intersection between an actual voltage-current characteristic curve between said charging member and said image bearing member and a predetermined voltage-current line predetermined for said charging member and said image bearing member, and for determining a bias to be applied to said charging member during image forming operation on the basis of the intersection, wherein said predetermined voltage-current line gives a different voltage if a current is different.

2. An apparatus according to claim 1, wherein the actual voltage-current characteristic curve is determined on the basis of electric currents provided when said charging member is constant-voltage-controlled with plural constant voltages.

3. An apparatus according to claim 2, wherein the electric currents are currents flowing through said charging member.

4. An apparatus according to claim 2, wherein the intersection is determined by gradually increasing or decreasing the plural constant voltages.

5. An apparatus according to claim 4, wherein the intersection is determined by gradually increasing or decreasing the plural voltages through pulse width modulation plural constant voltages.

6. An apparatus according to claim 2, wherein said charging member is controlled with pulse width modulation plural constant voltages.

7. An apparatus according to claim 2, wherein said image forming means forms a toner image on a recording material, and the plural constant voltages have a same polarity as a polarity of the toner image.

8. An apparatus according to claim 1, wherein the actual voltage-current characteristic curve is determined on the basis of voltages produced when said charging member is constant-current-controlled with plural constant currents.

9. An apparatus according to claim 1, wherein the predetermined voltage-current line indicates a different voltage if current is different.

10. An apparatus according to claim 9, wherein the predetermined voltage-current line indicates a smaller current for larger voltage.

11. An apparatus according to claim 1, wherein said charging member is a transfer member for transferring an image from said image bearing member to the recording material.

12. An apparatus according to claim 11, wherein said charging member is contactable to a backside of the recording material.

13. An apparatus according to claim 1 or 12, wherein said charging member is contactable to said image bearing member.

14. An apparatus according to claim 12, wherein said charging member is constant-voltage controlled during image transfer operation on the basis of a voltage determined by said determining means.

15. An apparatus according to claim 11, wherein the actual voltage-current characteristic curve is determined while the recording material is absent in an image transfer position.

16. An apparatus according to claim 1, wherein said apparatus is operable in a first mode for determining the bias to be applied to said charging member so that the bias is within a predetermined range from the intersection and in a second mode for determining the intersection while applying to the charging member the bias determined in an operation of the first mode.

17. An apparatus according to claim 16, wherein a plurality of biases is applied to the charging member in the first mode, and the bias to be applied to said charging member is determined on the basis of plural currents and voltages produced in the operation of the first mode, and in the second mode, the bias determined in the first mode is applied to said charging member, and a plurality of currents and voltages are produced, wherein the intersection is determined on the basis of the plural currents and voltages.

18. An apparatus according to claim 17, wherein the intersection is determined on the basis of averages of the plural currents or voltages.

19. An apparatus according to claim 18, wherein said charging member is a rotatable member, and bias determined in an operation of the first mode is applied to said charging member during an operation of the second mode, and the intersection is determined on the basis of an average of currents or voltages obtained from one full rotation of said charging member during an operation of the second mode.

20. An apparatus according to claim 15, 16, 17 or 19, wherein an operation of the first mode is carried out before a printing operation of said apparatus on a recording material, and wherein an operation of the second mode is carried out in a printing operation for the recording material.

21. An apparatus according to claim 17, wherein a period in which a current or voltage is sampled with a bias applied to said charging member is shorter in the first mode than in the second mode.

22. An apparatus according to claim 17, wherein said charging member is supplied with different biases in the second mode to determine the intersection, and wherein intervals between different biases are shorter in the second mode than in the first mode.

23. An image forming apparatus, comprising:

an image bearing member;

image forming means for forming an image on said image bearing member;

transfer charging member for transferring the image from said image bearing member onto a recording material;

a voltage source for supplying electric power to said transfer charging member;

constant voltage control means for constant-voltage-controlling said transfer charging member at a predetermined voltage; and wherein the predetermined voltage during transfer operation and current through said transfer charging member during a constant voltage operation in non-transfer operation, is changed in accordance with voltage-current characteristics between said transfer charging member and said image bearing member.

24. An apparatus according to claim 23, wherein with increase of a resistance of said transfer charging member, the predetermined voltage increases, and the electric current during non-transfer operation decreases.

25. An apparatus according to claim 23, wherein during the constant voltage control, the predetermined voltage is controlled with pulse width modulation.

26. An apparatus according to claim 23, wherein said transfer charging member is contactable to a backside of the recording material.

27. An apparatus according to claim 26, wherein said transfer charging member is contactable to said image bearing member.

28. An image forming apparatus, comprising:

image forming means for forming an image on a recording material, said image forming means including an image bearing member, a charging member for charging said image bearing member and a voltage source for supplying electric power to said charging member;

constant voltage control means for constant-voltage-controlling said charging member with a predetermined voltage; and wherein a constant voltage control operation of said constant voltage control operation is carried out for said charging member a plurality of times with different voltages, and a voltage applied to said charging member during image forming operation is determined on the basis of plural currents through said charging member during plural constant voltage control operations.

29. An apparatus according to claim 28, wherein the voltage applied to said charging member during image forming operation is determined by gradually increasing or decreasing the different voltages.

30. An apparatus according to claim 28 or 29, wherein the different voltages are controlled with pulse width modulation.

31. An apparatus according to claim 28, wherein said charging member is a transfer member for transferring the image from said image bearing member onto the recording material.

32. An apparatus according to claim 31, wherein said charging member is contactable to a back side of the recording material.

33. An apparatus according to claim 28 or 32, wherein said charging member is contactable to said image bearing member.

34. An apparatus according to claim 32, wherein said charging member is constant-voltage-controlled during image transfer operation on the basis of the thus determined voltage.

35. An apparatus according to claim 31, wherein the constant-voltage-control operation is carried out while the recording material is absent in an image transfer position.

36. An apparatus according to claim 28, wherein said apparatus is operable in a first mode in which the voltage of the constant voltage control operation is changed so as to be within a predetermined range from a voltage to be applied to said charging member to determine the voltage and in a second mode in which said charging member is constant-voltage-controlled with the voltage determined in the first mode, and the voltage applied to the charging member during image forming operation is determined on the basis of plural currents detected during constant voltage control with the voltage determined in the first mode.

37. An apparatus according to claim 36, wherein the voltage to be applied to said charging member is determined on the basis of an average of the plural currents.

38. An apparatus according to claim 37, wherein said charging member is a rotatable member, and wherein the constant voltage control in the second mode is carried out for one full turn of said charging member.

39. An apparatus according to claim 36, 37 or 38, wherein an operation of the first mode is carried out before printing operation on the recording material, and an operation of the second mode is carried out in a printing operation on the recording material.

40. An apparatus according to claim 36, wherein the electric current is sampled during the constant voltage control for a shorter period in the first mode than in the second mode.

41. An apparatus according to claim 36, in the second mode, said charging member is constant-voltage-controlled with plural voltages, wherein a period between the plural voltages is shorter in the second mode than in the first mode.

42. An apparatus according to claim 28, wherein said image forming means forms a toner image on the recording material, and plural voltages during the constant voltage control has a polarity which is the same as the polarity of the toner image.

43. An image forming apparatus, comprising:

image forming means for forming an image on a recording material, said image forming means including an image bearing member, a charging member for charging said image bearing member and a voltage source for supplying electric power to said charging member;

detecting means for detecting a plurality of sample values relating to a resistance of said charging member; and determining means for determining a voltage to be applied to said charging member during image forming operation of said apparatus in accordance with an output of said detecting means, wherein said detecting means carries out its detecting operation in a first mode in which a voltage or current applied to said charging member is increased or decreased with a first increment and in a second mode in which said charging member is supplied with a voltage or current which is determined on the basis of the sample values in the first mode and which is increased or decreased with a second increment, wherein the second increment is smaller than the first increment.

44. An apparatus according to claim 43, wherein the voltage or current applied to said charging member is controlled with pulse width modulation.

45. An apparatus according to claim 43, wherein said charging member is a transfer member for transferring the image from said image bearing member onto the recording material.

46. An apparatus according to claim 45, wherein said charging member is contactable to a backside of the recording material.

47. An apparatus according to claim 43 or 46, wherein said charging member is contactable to said image bearing member.

48. An apparatus according to claim 46, wherein said charging member is constant-voltage-controlled with the voltage determined by said determining means, during transfer operation.

49. An apparatus according to claim 45, wherein said detecting means detects the sample values, while the recording material is absent in a transfer position.

50. An apparatus according to claim 43, wherein the sampled values are currents produced when said charging member is constant-voltage-controlled.

51. An apparatus according to claim 43, wherein the sampled values are voltages produced when said charging member is constant-current-controlled.

52. An apparatus according to claim 43, wherein detection of the sample values in the first mode is continued until the sample values are within a predetermined range.

53. An apparatus according to claim 43, wherein a voltage to be applied to said charging member during the image forming operation is determined on the basis of an average of sample values detected in the second mode.

54. An apparatus according to claim 53, wherein said charging member is a rotatable member, and wherein the voltage to be applied to said charging member during the image forming operation is determined on the basis of an average of the sampled values obtained from one full rotation of said charging member.

55. An apparatus according to claims 43, 52, 53 and 54, wherein an operation of the first mode is carried out before printing operation on the recording material, and an operation of the second mode is carried out in the printing operation on the recording material.

56. An apparatus according to claim 43, wherein a detecting period of one sample value by said detecting means is shorter in the first mode than in the second mode.

57. An apparatus according to claim 43, wherein said image forming means forms a toner image on the recording material, and the voltage and the currents have the opposite to the polarity of the toner image.

58. An image forming apparatus, comprising:

image forming means for forming an image on a recording material, said image forming means including an image bearing member, a charging member and a voltage source for supplying electric power to said charging member;

constant voltage control means for constant-voltage-controlling said charging member with a predetermined voltage;

detecting means for detecting current flowing through said charging member;

wherein said constant voltage control means constant voltage controls a voltage applied to said charging member a plurality of times with different voltages, and wherein the voltage supplied to said charging member is determined on the basis of a voltage corresponding to a predetermined current detected by said detecting means by the operation of said constant voltage control means.

59. An apparatus according to claim 58, wherein said predetermined current is constant irrespective of actual voltage-current characteristics between said charging member and said image bearing member.

60. An apparatus according to claim 58, wherein the voltage applied to said charging member during image forming operation is determined by gradually increasing or decreasing the different voltages.

61. An apparatus according to claim 58 or 60, wherein the different voltages are controlled with pulse width modulation.

62. An apparatus according to claim 58, wherein said charging member is a transfer member for transferring the image from said image bearing member onto the recording material.

63. An apparatus according to claim 62, wherein said charging member is contactable to a back side of the recording material.

64. An apparatus according to claim 58 or 63, wherein said charging member is contactable to said image bearing member.

65. An apparatus according to claim 63, wherein said charging member is constant-voltage-controlled during image transfer operation on the basis of the thus determined voltage.

66. An apparatus according to claim 62, wherein the constant-voltage-control operation is carried out while the recording material is absent is an image transfer position.

67. An apparatus according to claim 58, wherein said apparatus is operable in a first mode in which the voltage of the constant voltage control operation is changed so as to be within a predetermined range from a voltage to be applied to said charging member to determine the voltage and in a second mode in which said charging member is constant-voltage-controlled with the voltage determined in the first mode, and the voltage applied to the charging member during image forming operation is determined on the basis of plural currents detected during constant voltage control with the voltage determined in the first mode.

68. An apparatus according to claim 67, wherein the voltage to be applied to said charging member is determined on the basis of an average of the plural currents.

69. An apparatus according to claim 68, wherein said charging member is a rotatable member, and the plural currents is obtained during one full rotation of said charging member.

70. An apparatus according to claim 67, 68 or 69, wherein an operation of the first mode is carried out before printing operation on the recording material, and an operation of the second mode is carried out in a printing operation on the recording material.

71. An apparatus according to claim 67, wherein the electric current is sampled during the constant voltage control for a shorter period in the first mode than in the second mode.

72. An apparatus according to claim 58, wherein said image forming means forms a toner image on the recording material, and plural voltages during the constant voltage control has a polarity which is the same as the polarity of the toner image.

73. An image forming apparatus, comprising:

image forming means for forming an image on a recording material, said image forming means including an image bearing member, a charging member for charging said image bearing member and a voltage source for supplying electric power to said charging member; and means for detecting an electric current through said charging member;

storing means for storing a first voltage on the basis of a voltage applied to said charging member when said detecting means detects a predetermined current in a first mode operation in which the voltage applied to said charging member is changed; and determining means for determining a second voltage to be applied to said charging member during image forming operation on the basis of a current detected by said detecting means in a second mode operation in which a voltage on the basis of the first voltage is applied to said charging member.

74. An apparatus according to claim 73, wherein said detecting means detects the current flowing from said charging member to the image bearing member.

75. An apparatus according to claim 73, wherein said storing means stores the first voltage immediately after a main switch to said apparatus is actuated.

76. An apparatus according to claim 73 or 75, wherein the voltage determined on the basis of the first voltage is applied in the second mode after a printing signal is applied to said apparatus.

77. An apparatus according to claim 76, wherein said charging member transfers the image from said image bearing member to the recording material at a transfer position.

78. An apparatus according to claim 77, wherein the voltage determined on the basis of the first voltage is applied to said charging member when the recording material is not at a transfer position.

79. An apparatus according to claim 73, wherein in said first mode, there is provided a period in which the voltage applied to said charging member is increased with predetermined steps to make the current closer to a predetermined current.

80. An apparatus according to claim 73, wherein an initial level of the voltage applied in the second mode is closer to the voltage applied during the image forming operation than the voltage initially applied during the first mode.

81. An apparatus according to claim 80, wherein the voltage applied initially to said charging member in the second mode, is larger than the voltage applied initially to said charging member in the first mode.

82. An apparatus according to claim 73, wherein the predetermined current is constant irrespective of a resistance of said charging member.

83. An apparatus according to claim 73, wherein the voltage determined on the basis of the first voltage in the second mode is variable.

84. An apparatus according to claim 73, wherein said charging member transfers the image from said image bearing member to the recording material.

85. An apparatus according to claim 84, wherein said charging member is contactable to a backside of the recording material.

86. An apparatus according to claim 73 or 85, wherein said charging member is contactable to said image bearing member.

87. An apparatus according to claim 85, wherein said charging member is constant-voltage-controlled with the voltage determined by said determining means during image transfer operation.

88. An apparatus according to claim 73 or 84, wherein said charging member is a rotatable member.

89. An apparatus according to claim 88, wherein said first voltage is determined on the basis of a plurality of the voltages applied to said charging member during at least one rotation of said charging member, while the current detected by said detecting means is being maintained at a predetermined level.

90. An apparatus according to claim 89, wherein said first voltage is based on an average of the plurality of the voltages.

91. An apparatus according to claim 88, wherein the voltage determined by said determining means is based on a plurality of the voltages applied to said charging member during at least one rotation of said charging member while maintaining constant the current detected by said detecting means.

92. An apparatus according to claim 91, wherein the voltage determined by said determining means is based on an average of the plurality of the voltages.

93. An apparatus according to claim 84, further comprising charging means for charging said image bearing member to form an image on said image bearing member, wherein said charging means has a charging property which is opposite from a polarity of said voltage source.

94. An apparatus according to claim 73, wherein said second voltage is determined on the basis of a voltage applied to said charging member when said current is at a predetermined level.

95. An image forming apparatus, comprising:

image forming means for forming an image on a recording material, said image forming means including an image bearing member, a charging member for transferring the image from said image bearing member to the recording material at a transfer position and a voltage source for supplying electric power to said charging member;

means for detecting an electric current through said charging member;

storing means for storing a first voltage on the basis of a voltage applied to said charging member when said detecting means detects a predetermined current in a first operation mode in which the voltage applied to said charging member is changed; and determining means for determining a second voltage to be applied to said charging member during image forming operation on the basis of a current detected by said detecting means in a second operation mode in which a voltage on the basis of the first voltage is applied to said charging member.

96. An apparatus according to claim 95, wherein said detecting means detects the current flowing from said charging member to an image bearing member.

97. An apparatus according to claim 95, wherein said storing means stores the first voltage immediately after a main switch to said apparatus is actuated.

98. An apparatus according to claim 95 or 97, wherein the voltage determined on the basis of the first voltage is applied in the second operation mode after a printing signal is applied to said apparatus.

99. An apparatus according to claim 95, wherein in said first operation mode, there is provided a period in which the voltage applied to said charging member is increased with predetermined steps to make the current closer to a predetermined current.

100. An apparatus according to claim 95, wherein an initial level of the voltage applied in the second operation mode is closer to the second voltage applied during the image forming operation then the voltage initially applied during the first operation operation mode.

101. An apparatus according to claim 100, wherein the voltage applied initially to said charging member in the second operation mode, is larger than the voltage applied initially to said charging member in the first mode.

102. An apparatus according to claim 95, wherein the predetermined current is constant irrespective of a resistance of said charging member.

103. An apparatus according to claim 95, wherein the voltage determined on the basis of the first voltage in the second operation mode is variable.

104. An apparatus according to claim 95, wherein said charging member is constant-voltage-controlled with the second voltage determined by said determining means during image transfer operation.

105. An apparatus according to claim 95, wherein said charging member is a rotatable member.

106. An apparatus according to claim 105, wherein said first voltage is determined on the basis of a plurality of the voltages applied to said charging member during at least one rotation of said charging member, while the current detected by said detecting means is being maintained at a predetermined level.

107. An apparatus according to claim 106, wherein said first voltage is based on an average of the plurality of the voltages.

108. An apparatus according to claim 105, wherein the second voltage determined by said determining means is based on a plurality of the voltages applied to said charging member during at least one rotation of said charging member while maintaining constant the current detected by said detecting means.

109. An apparatus according to claim 108, wherein the second voltage determined by said determining means is based on an average of the plurality of the voltages.

110. An apparatus according to claim 95, wherein the voltage determined on the basis of the first voltage is applied to said charging member when the recording material is not at the transfer position.

111. An apparatus according to claim 110, wherein when the recording material is not present at the transfer position, said first operation mode operation is carried out.

112. An apparatus according to claim 95, further comprising charging means for charging said image bearing member to form an image on said image bearing member, wherein said charging means has a charging property which is opposite from a polarity of said voltage source.

113. An apparatus according to claim 95, wherein said second voltage is determined on the basis of a voltage applied to said charging member when said current is at a predetermined level.

114. An apparatus according to any one of claims 95–97 or 99–113, wherein said charging member is contactable to a backside of the recording material.

115. An apparatus according to claim 114, wherein said charging member is contactable to said image bearing member.

* * * * *

UNITED STATES PATENT AND TRADEMARK OFFICE

CERTIFICATE OF CORRECTION

PATENT NO. : 5,646,717

DATED : July 8, 1997

INVENTORS : Koichi Hiroshima, et al.

It is certified that error appears in the above-identified patent and that said Letters Patent is hereby corrected as shown below:

IN THE DRAWINGS

Sheet, 14, Figure 15, "LOARD" should read --LOAD-- and "TRASFORMER" should read --TRANSFORMER--; and
Sheet 23, Figure 24, "WARMIN-UP" should read --WARMING-UP--.

COLUMN 1

Line 65, "such" should be deleted.

COLUMN 9

Line 66, "test" should read --tests--.

COLUMN 10

Line 36, "practically" should read --practical--; and
Line 55, "resistance is detected," should read --resistance,--.

COLUMN 11

Line 57, "a simultaneous" should read --simultaneous--.

COLUMN 13

Line 36, "relative" should read --relatively--.

UNITED STATES PATENT AND TRADEMARK OFFICE

CERTIFICATE OF CORRECTION

PATENT NO. : 5,646,717

DATED : July 8, 1997

INVENTORS : Koichi Hiroshima, et al.

It is certified that error appears in the above-identified patent and that said Letters Patent is hereby corrected as shown below:

COLUMN 16

Line 57, "and" should be deleted; and
Line 67, "high" should read --highly--.

COLUMN 17

Line 22, "closed" should read --close--.

COLUMN 26

Line 4, "claim 15, 16, 17" should read --claim 16, 17, 18--.

COLUMN 27

Line 54, "same as" should read --opposite to--.

COLUMN 29

Line 40, "absent is" should read --absent in--; and
Line 57, "currents is" should read --currents are--.

UNITED STATES PATENT AND TRADEMARK OFFICE

CERTIFICATE OF CORRECTION

PATENT NO. : 5,646,717

DATED : July 8, 1997

INVENTORS : Koichi Hiroshima, et al.

It is certified that error appears in the above-identified patent and that said Letters Patent is hereby corrected as shown below:

COLUMN 32

Line 8, "then" should read --than-- and "mode," should read --mode--.

Signed and Sealed this

Third Day of February, 1998

*Attest:*

BRUCE LEHMAN

*Attesting Officer*

*Commissioner of Patents and Trademarks*